US006394789B1

(12) United States Patent
Yabuuchi et al.

(10) Patent No.: US 6,394,789 B1
(45) Date of Patent: May 28, 2002

(54) CATALYST COMBUSTION DEVICE

(75) Inventors: Hidetaka Yabuuchi, Hyogo; Toshinari Matsumoto; Shinichi Nakajima, both of Osaka; Tomoaki Kitano, Nara, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/622,129

(22) PCT Filed: Dec. 17, 1999

(86) PCT No.: PCT/JP99/07090

§ 371 (c)(1),
(2), (4) Date: Sep. 25, 2000

(87) PCT Pub. No.: WO00/37854

PCT Pub. Date: Jun. 29, 2000

(30) Foreign Application Priority Data

| | | |
|---|---|---|
| Dec. 18, 1998 | (JP) | 10-361008 |
| Dec. 21, 1998 | (JP) | 10-363262 |
| Mar. 26, 1999 | (JP) | 11-083309 |
| Jun. 11, 1999 | (JP) | 11-164881 |

(51) Int. Cl.[7] ..... F23D 3/40

(52) U.S. Cl. ..... 431/7; 431/268; 431/328; 431/170

(58) Field of Search ..... 431/7, 11, 268, 431/170, 328, 326, 327, 329; 126/92 AC, 85 R

(56) References Cited

U.S. PATENT DOCUMENTS

| | | | | |
|---|---|---|---|---|
| 5,346,389 A | * | 9/1994 | Retallick et al. | 431/7 |
| 5,352,114 A | * | 10/1994 | Numoto et al. | 431/7 |
| 5,403,184 A | * | 4/1995 | Hosaka et al. | 431/328 |
| 5,938,427 A | * | 8/1999 | Suzuki et al. | 431/7 |

FOREIGN PATENT DOCUMENTS

| | | |
|---|---|---|
| JP | 6-147436 | 5/1994 |
| JP | 9-170708 | 6/1997 |
| JP | 10-89616 | 4/1998 |
| JP | 10-204706 | 8/1998 |
| JP | 10-309476 | 11/1998 |

* cited by examiner

*Primary Examiner*—James C. Yeung
(74) *Attorney, Agent, or Firm*—Wenderoth, Lind & Ponack, L.L.P.

(57) ABSTRACT

A catalytic combustion apparatus comprises a combustor 11, a fuel tank 12, a valve 13, and an ignition device 14. The combustor 11 further comprises a gas nozzle 16, an air intake/ejector 17, a mixing chamber 18, a firing chamber 19, an ignition plug 20, a combustion chamber 21, a catalyst for combustion 22 housed inside the combustion chamber 21, and an exhaust port 23. The mixing chamber 18 is made into a straight cylindrical passage, a cylindrical firing chamber 19 is provided in parallel to the mixing chamber 18 so that an opening 24 on the side of the firing chamber 19 communicates with the combustion chamber 21, a burner port 25 is disposed on the boundary between the mixing chamber 18 and the firing chamber 19, and the burner 25 is configured with a catalytic net 25*a*. With this configuration, a flame is formed on the upstream side of the catalyst for combustion 22, the catalyst for combustion 22 is heated by the heat of the flame to a catalytic combustion enabling temperature thus also effecting catalytic combustion on the catalytic net 25*a*. The flame spontaneously disappears, and the catalyst for combustion 22 commences catalytic combustion. As catalytic combustion can be effected without fail even when the combustion chamber 21 is configured into a low profile, the thickness of the catalytic body can be reduced without reducing the combustion characteristics, thereby enabling reduction in the height of the burner and providing a downsized and thin catalytic combustion apparatus.

18 Claims, 23 Drawing Sheets

(a)

(b)

CATALYST COMBUSTION DEVICE

FIELD OF THE INVENTION

The present invention relates to a catalytic combustion apparatus for combustion of gaseous fuel or liquid fuel.

BACKGROUND OF THE INVENTION

An existing catalytic combustion apparatus is of a configuration as illustrated in FIG. 29, for example. In the diagram, numeral 1 is a gas tank for storing liquefied petroleum gas such as butane, propane, and the like. Fuel gas contained inside the gas tank 1 is ejected from a gas nozzle 3 passing through a gas passage 2. The gas ejected from the gas nozzle 3 draws in air through an air intake 4 by the effect of gas flow ejection and is mixed with air in a mixing chamber 5, and is then supplied to a combustion chamber 6. There being a catalytic body 7 inside the combustion chamber 6, the mixed gas burns by the catalytic action as it passes an internal passage 7' of the catalytic body 7 and generates combustion heat. An ignition device 8 is provided opposite the mixed gas entrance of the combustion chamber 6. When starting the apparatus, the mixed gas is ignited by a spark generated by a spark plug 9 provided on the tip of the ignition device 8. The catalytic body 7 is heated by a flame formed downstream of the catalytic body 7. When the temperature of the catalytic body 7 reaches the active temperature, catalytic combustion starts to take place on the surface of the catalytic body 7, the supply of the mixed gas to the flame is stopped, and the flame disappears. Under this condition, the mixed gas supplied to the combustion chamber 6 undergoes catalytic combustion over the entire catalytic body 7, and the combustion gas is exhausted from an exhaust port 10.

Such a catalytic combustion apparatus is being used in portable irons and warming devices.

However, as such existing catalytic combustion apparatus suffers several problems when trying to make it smaller and thinner for better portability, there was a limit in the improvement of portability.

To be more specific, an existing catalytic body 7 is generally a cylindrical honeycomb made of ceramic or metal supporting a catalyst. As its diameter is roughly determined by the amount of combustion, the height of the burner cannot be made smaller than this diameter. Furthermore, when the catalytic body 7 is made unreasonably small, it will present a problem of not being able to obtain a predetermined heating value as the combustion characteristic is lowered.

Additionally, as existing catalytic combustion apparatuses are configured in a straight line by directly coupling a mixing chamber 5 and a catalytic body 7, the total length of the burner tends to be large. Though the combustion chamber 5 may be bent in order to make the length shorter, such configuration will suffer non-uniform distribution of the mixed gas flow velocity and will result in non-uniform combustion on the catalytic body 7, thereby presenting fundamental difficulty in making the size smaller. Also, when the catalytic body 7 is formed into the shape of a thin plate, the velocity of flow of the mixed gas becomes high when a flame for the purpose of firing is formed on the downstream side of the catalytic body 7, and the flame is formed apart from the catalytic body 7, thereby either delaying or stopping transition to catalytic combustion. Downsizing will also suffer a problem of causing a higher watt density, leading to an excessive increase in the catalyst temperature thereby shortening the life of the catalyst.

The present inventors had already developed a thin type catalytic combustion system in which the height of the burner was made low by disposing a catalytic body formed in the shape of a flat plate with its planar area greater than the area of the side, and providing a gas passage on the catalytic body to allow flow of mixed gas in the lateral direction. However, in manufacturing a low-profile burner, difficulties were faced in the method of fabrication. To be more specific, when employing a structure in which a nozzle, a catalytic body, etc., are mounted onto a mother component in which a mixing chamber, a combustion chamber, etc., have been formed into a single piece by aluminum die casting, for example, there was a limit in making the mother component thinner in which the mixing chamber and the combustion chamber had been integrally formed into a single piece from the standpoint of the thickness of molding, etc., to say nothing of the difficulty in securing precision.

SUMMARY OF THE INVENTION

The present invention addresses the above described issues of the prior art. It is an object of the present invention to make a smaller and thinner burner by making the height and length smaller while securing ignitability thereby to provide a catalytic combustion apparatus which is superior in durability and portability.

A description will now be given of exemplary embodiments of the present invention for achieving the above objective.

A first exemplary embodiment of the present invention comprises a combustor, a fuel tank, a valve, and an ignition device, wherein the combustor further comprises a gas nozzle, an air intake/ejector, a mixing chamber, a firing chamber, an ignition plug, a combustion chamber, a catalyst for combustion (first catalyst) housed in the combustion chamber, and an exhaust port. The mixing chamber is a straight cylindrical passage, a cylindrical firing chamber of which an opening on its side communicating with the combustion chamber is provided in parallel to the mixing chamber, a burner port is disposed on the boundary of the mixing chamber and the firing chamber, and the burner port comprises a catalytic net (second catalyst). With this structure, it is made possible to form a flame on the upstream side of the catalyst for combustion, and heat the catalyst for combustion to a catalytic combustion enabling temperature with the heat of the flame thus causing catalytic combustion on the catalytic net, too, whereby the flame spontaneously disappears allowing the catalyst for combustion to commence catalytic combustion, and suggesting that catalytic combustion can be performed without fail even when the combustion chamber is configured with a low profile. Furthermore, as the combustion takes place on both the catalytic net and the catalyst for combustion, the temperature rise of the catalyst for combustion is kept small and the life is lengthened. As a result, the thickness of the catalytic body can be made smaller without sacrificing the igniting characteristics and durability, thereby allowing the burner height to be made smaller and providing a smaller and thinner catalytic combustion apparatus.

A second exemplary embodiment is configured such that, in a catalytic combustion apparatus as described in the first exemplary embodiment, the combustion on the catalytic net, is adjusted to half of the entire combustion thereby to quickly extinguish the flame to allow smooth transition to catalytic combustion as well as to halve the combustion on the catalytic net thus lengthening the life of both the catalytic net and the catalyst for combustion.

A third exemplary embodiment of the present invention comprises a combustor, a fuel tank, a valve, and an ignition device, wherein the combustor further comprises a gas nozzle, an air intake/ejector, an air intake, a mixing chamber, a firing chamber, a burner port provided in the firing chamber, an ignition plug, a combustion chamber, a catalyst for combustion housed in the combustion chamber, and an exhaust port. An intake-air shutter is provided on the air intake which is operable by a temperature detecting means provided in the vicinity of the combustion chamber. With this arrangement, the ratio of combustion on the catalytic net can be lowered by making the velocity of the fuel air mixed gas passing through the catalytic net greater by increasing the air-to-fuel ratio after transition to catalytic combustion, thereby to secure the life of the catalytic net. Also, by increasing the air-to-fuel ratio, the temperature of the catalyst for combustion is lowered and the durability is improved.

A fourth exemplary embodiment is a catalytic combustion apparatus as described in the first exemplary embodiment comprising a combustor, a fuel tank, a valve, and an ignition device, wherein the combustor further comprises a gas nozzle, an air intake/ejector, an air intake, a mixing chamber, a firing chamber, a burner port provided in the firing chamber, an ignition plug, a combustion chamber, a catalyst for combustion housed in the combustion chamber, and an exhaust port. A quantity-of-flow adjustable means is provided between the valve and the combustor so that the adjustable range of the amount of combustion can be widened in a manner such that when the quantity of gas flow is reduced by adjusting the quantity-of-flow adjustable means, combustion will take place on the combustion net only, and when the quantity of gas flow is increased, combustion will take place on both the catalytic net and the catalyst for combustion.

A fifth exemplary embodiment is an invention as described in the first exemplary embodiment comprising a combustor, a fuel tank, a valve, and an ignition device, in which the combustor further comprises a gas nozzle, an air intake/ejector, an air intake, a mixing chamber, a firing chamber, an ignition plug, a combustion chamber, a catalyst for combustion housed in the combustion chamber, and an exhaust port. The mixing chamber is a straight cylindrical passage, a cylindrical firing chamber a side opening of which communicating with the combustion chamber is provided in parallel to the mixing chamber, a burner port is provided on the boundary between the mixing chamber and the firing chamber, the burner port is configured with a catalytic net, and the mixing chamber and a part of the catalytic net are made to come into contact with each other so that the heat of the catalytic net can be conducted to the combustor through the wall of the mixing chamber, thereby suppressing the temperature rise of the catalytic net and securing the life of the catalytic net.

A sixth exemplary embodiment is one in which the catalytic net of the fifth exemplary embodiment is formed in the shape of a square letter C so that its two sides come into contact with the wall of the mixing chamber thereby to remove dispersion of the area of contact between the mixing chamber and the catalytic net during assembly work and to obtain stable characteristics.

A seventh exemplary embodiment is a catalytic combustion apparatus as described in the fifth exemplary embodiment, in which the catalytic net is formed in the shape of an open square so that its three sides come into contact with the wall of the mixing chamber. As it is made easy to maintain the shape of the catalytic net, dispersion of the area of contact between the mixing chamber and the catalytic net during assembly work can be removed, and stable characteristics can be obtained.

An eighth exemplary embodiment is a catalytic combustion apparatus, in which the ignition plug is disposed in the end of the firing chamber where the density of combustion gas becomes high thereby to assure firing and allow reduction in size and thickness.

A ninth exemplary embodiment is a catalytic combustion apparatus, in which a part of the catalyst for combustion is disposed in such a way that it projects into the firing chamber thereby to increase the speed of transition to catalytic combustion by increasing the rate of temperature rise of the catalyst for combustion and allow reduction in size and thickness.

A tenth exemplary embodiment is a catalytic combustion apparatus, in which the air intake/ejector is provided with a quantity-of-flow adjustable means for varying the quantity of intake air thereby to improve combustion characteristics during catalytic combustion by increasing the ratio of excess air upon transition to catalytic combustion and allow reduction in size and thickness.

An eleventh exemplary embodiment is a catalytic combustion apparatus, in which the valve comprises a solenoid valve and a control apparatus, and the control apparatus controls the solenoid valve in a manner such that the control apparatus temporarily closes the solenoid valve after an ignition device has operated and subsequently opens it again thereby to assure smooth transition to catalytic combustion and allow reduction in size and thickness.

A twelfth exemplary embodiment is a catalytic combustion apparatus, in which the valve is provided with a quantity-of-flow adjustable means for adjusting the quantity of intake air, and the quantity-of-flow adjustable means is fully opened to allow the ignition device to ignite, and throttles back the quantity of supply of fuel gas after ignition thereby to assure stable ignition and transition to catalytic combustion and to allow reduction in size and thickness.

A thirteenth exemplary embodiment is a catalytic combustion apparatus, in which the valve comprises a solenoid valve and a control apparatus, and the control apparatus controls the solenoid valve to be temporarily closed based on a signal from a temperature detecting means disposed in the combustion chamber thereby to assure ignition and stable transition to catalytic combustion and to allow reduction in size and thickness.

A fourteenth exemplary embodiment is a catalytic combustion apparatus, in which the exhaust port is disposed on the combustor in such a manner that it will not overlap the combustion chamber and will come to a position opposite the direction of ejection of mixed gas into the mixing chamber thereby to allow uniform catalytic combustion through uniform passage of the mixed gas through the catalyst for combustion and reduction in size and thickness.

A fifteenth exemplary embodiment is a catalytic combustion apparatus, in which a burner port area adjustable means provided on the combustor is operable with a signal from a temperature detecting means provided in the vicinity of the burner port thereby to allow instantaneous transition to catalytic combustion by reducing the open area of the burner port upon reaching a catalytic combustion enabling temperature.

A sixteenth exemplary embodiment is a catalytic combustion apparatus, in which the catalyst for combustion is affixed to the combustion chamber with a space between itself and the inner wall of the combustion chamber thereby to reduce the quantity of transfer of the heat generated by the catalyst for combustion to the combustor and to keep the temperature of the outer wall low even when the apparatus is downsized to obtain user-friendliness.

A seventeenth exemplary embodiment is a catalytic combustion apparatus, in which the catalyst for combustion is provided with a thickness adjustable means for adjusting thickness thereby enabling adjustment of the quantity of heat transfer to the combustor in order to obtain a wide temperature control range.

An eighteenth exemplary embodiment is a catalytic combustion apparatus, in which a catalytic body formed into the shape of a flat plate of which the area of the planar surface is greater than the area of the side is disposed inside the combustion chamber and a gas passage to allow flow of mixed gas in the lateral direction is provided on the catalytic body, thereby making the burner height low and providing a small sized and thin catalytic combustion apparatus.

A nineteenth exemplary embodiment is a catalytic combustion apparatus, in which a straight cylindrical gas passage communicating with the outlet of the mixing chamber is provided and the inlet of the combustion chamber is made to communicate with a side of the gas passage so that the mixing chamber and the catalytic body are disposed in parallel to each other thereby to shorten the burner length to obtain a compact design.

A twentieth exemplary embodiment is a catalytic combustion apparatus, in which the length of the straight cylindrical gas passage is made longer than the width of the inlet of the combustion chamber and the inlet of the combustion chamber is disposed inside the straight cylindrical gas passage thereby to allow more uniform mixing of fuel gas and air and to uniformly supply the mixed gas to the catalytic body.

A twenty-first exemplary embodiment is a catalytic combustion apparatus, in which a gas flow resistant body is provided in the outlet of the mixing chamber to reduce the velocity of mixed gas flow thereby to slow down the velocity of the mixed gas flow inside the straight cylindrical gas passage and to uniformly supply the mixed gas to the catalytic body.

A twenty-second exemplary embodiment is a catalytic combustion apparatus, in which a gas rectifier is provided in the inlet of the combustion chamber to rectify the flow of mixed gas thereby to rectify the mixed gas that comes out from the straight cylindrical gas passage and to uniformly supply the mixed gas to the catalytic body.

A twenty-third exemplary embodiment is a catalytic combustion apparatus, in which the catalytic body supports a catalyst on a corrugated carrier made by folding a thin metal sheet into the shape of continuous waves thereby to provide a catalytic body which is simple in shape, simple to continuously. process, and superior in mass producibility.

A twenty-fourth exemplary embodiment is a catalytic combustion apparatus, in which the catalytic body supports a catalyst on a multilayer carrier fabricated by alternately stacking a corrugated sheet made by folding a thin metal sheet into the shape of continuous waves and a flat thin metal sheet thereby to secure high combustion efficiency even when the amount of combustion is increased.

A twenty-fifth exemplary embodiment is a catalytic combustion apparatus comprising a nozzle for ejecting a fuel gas, a mixing chamber for making a mixed gas by mixing the fuel gas ejected from the nozzle and air, and a combustion chamber having a catalytic body inside it for burning the mixed gas, in which the combustion chamber is comprised of discrete components which can be divided into the mixing chamber, nozzle, and catalytic body, thereby to provide a small and thin catalytic combustion apparatus with a low burner height.

A twenty-sixth exemplary embodiment is a catalytic combustion apparatus, in which the combustion chamber comprises a plurality of components divided by a plane approximately in parallel with the direction of ejection from the nozzle thereby to lower the height of the combustion chamber.

A twenty-seventh exemplary embodiment is a catalytic combustion apparatus, in which a subassembly integrating the combustion chamber and the nozzle is secured by sandwiching a plurality of components that comprise the combustion chamber thereby to downsize the mixing chamber and the nozzle.

A twenty-eighth exemplary embodiment is a catalytic combustion apparatus, in which a temperature detecting means for detecting the temperature of the combustion chamber and a control unit for controlling the quantity of ejection of the fuel gas based on the output of the temperature detecting means are provided. The temperature detecting means is secured by a plurality of components that comprise the combustion chamber thereby to simplify the structure of affixing the temperature detecting means to the combustion chamber, downsize the combustion chamber, as well as to assure securing of the temperature detecting means by sandwiching it with the combustion chamber.

DESCRIPTION OF THE PREFERRED EMBODIMENTS

A description of exemplary embodiments of the present invention will be given in the following.

EXAMPLE—1

Figure 1:
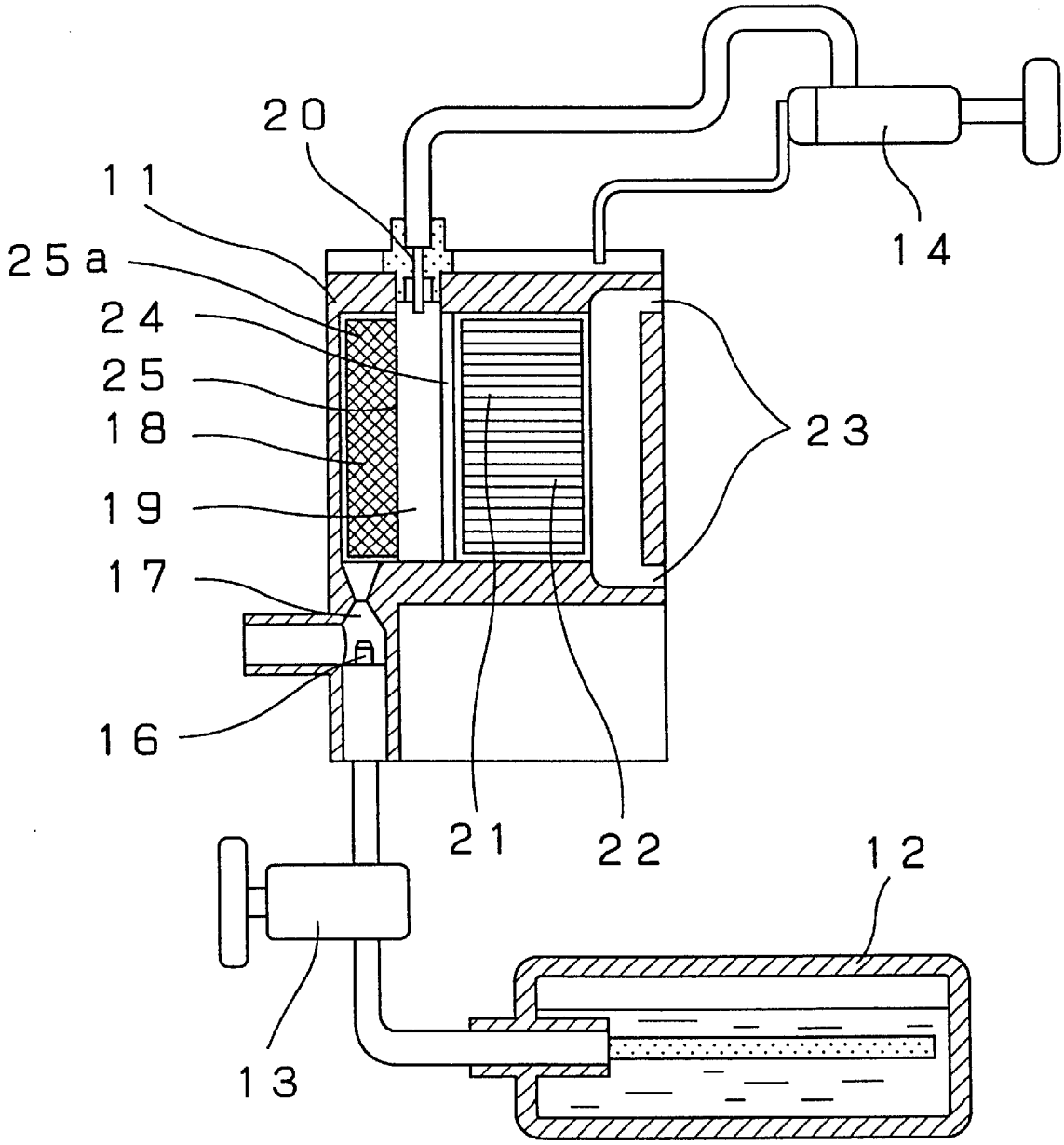
FIG. 1 is a cross-sectional view of the overall structure of a catalytic combustion apparatus in a first example of the present invention.

FIG. 1 is a cross-sectional view to illustrate the overall structure of a catalytic combustion apparatus. Numeral 11 is a combustor, numeral 12 is a fuel tank, numeral 13 is a valve, numeral 14 is an ignition device using a piezoelectric element, numeral 16 is a gas nozzle, numeral 17 is an ejector for drawing in air by the ejecting energy of fuel, numeral 18 is a straight cylindrical mixing chamber for mixing a fuel gas and air, and numeral 19 is a cylindrical firing chamber of which an opening 24 on the side communicates with a combustion chamber 21. Numeral 20 is an ignition plug for generating a spark inside the firing chamber 19, numeral 22 is a catalyst for combustion housed inside the combustion chamber 21, numeral 23 is an exhaust port for discharging combustion gas. Numeral 25 is a burner port provided on the boundary between the mixing chamber 18 and the firing chamber 19 and is configured with a catalytic net 25*a* which supports a catalyst with platinum as the main component on a high heat resistance metal net. The catalytic net 25*a* supports approximately 2.5 mg of platinum which is capable of burning 70 to 80% of the fuel gas. A flame is formed on the catalytic net 25*a*, whereby the catalyst for combustion 22 is heated to catalytic combustion enabling temperature. A flame is formed on the burner port 25 by opening the valve 13 to allow ejection of the fuel gas from the gas nozzle 16 and igniting it with the ignition device 14. As the burner is made thin, the area of the opening of the burner port 25 is made small and the velocity of flow of the mixed gas is made high thereby forming a flame at some distance from the burner port 25. As a result, the flame approaches the catalyst for combustion 22, the catalyst for combustion 22 is easily heated, and the temperature of the catalyst for combustion 22 reaches 200 degrees C. or higher in several seconds which is generally regarded as the catalytic combustion enabling temperature. As the heat capacity of the catalytic net 25*a* is small, its temperature instantly rises even when a flame is formed apart from it, and catalytic combustion commences on the catalytic net 25*a* almost simultaneously. The flame formed on the burner port spontaneously disappears, and catalytic combustion commences on the catalyst for combustion 22. As catalytic combustion can be securely effected in this way even when the combustion chamber 21 is configured thin, the thickness of the catalyst for combustion 22 can be reduced without lowering the firing characteristic. Furthermore, as combustion takes place on both the catalytic net 25*a* and the catalyst for combustion 22, the temperature of the catalyst for combustion 22 remains low thus lengthening its life. Consequently, the burner height can be reduced while securing the firing performance and durability thereby enabling downsizing and thin design.

In the catalytic combustion apparatus of FIG. 1, by making the quantity of platinum supported by the catalytic net 25*a* to be approximately 1.7 mg and adjusting the combustion on the catalytic net 25*a* to be approximately half, namely, 40 to 70%, of the entire combustion, a flame can be quickly put out while undergoing smooth transition to catalytic combustion, and at the same time the combustion on the catalytic net 25*a* can be halved thereby lengthening the life of both the catalytic net 25*a* and the catalyst for combustion 22.

Figure 2:
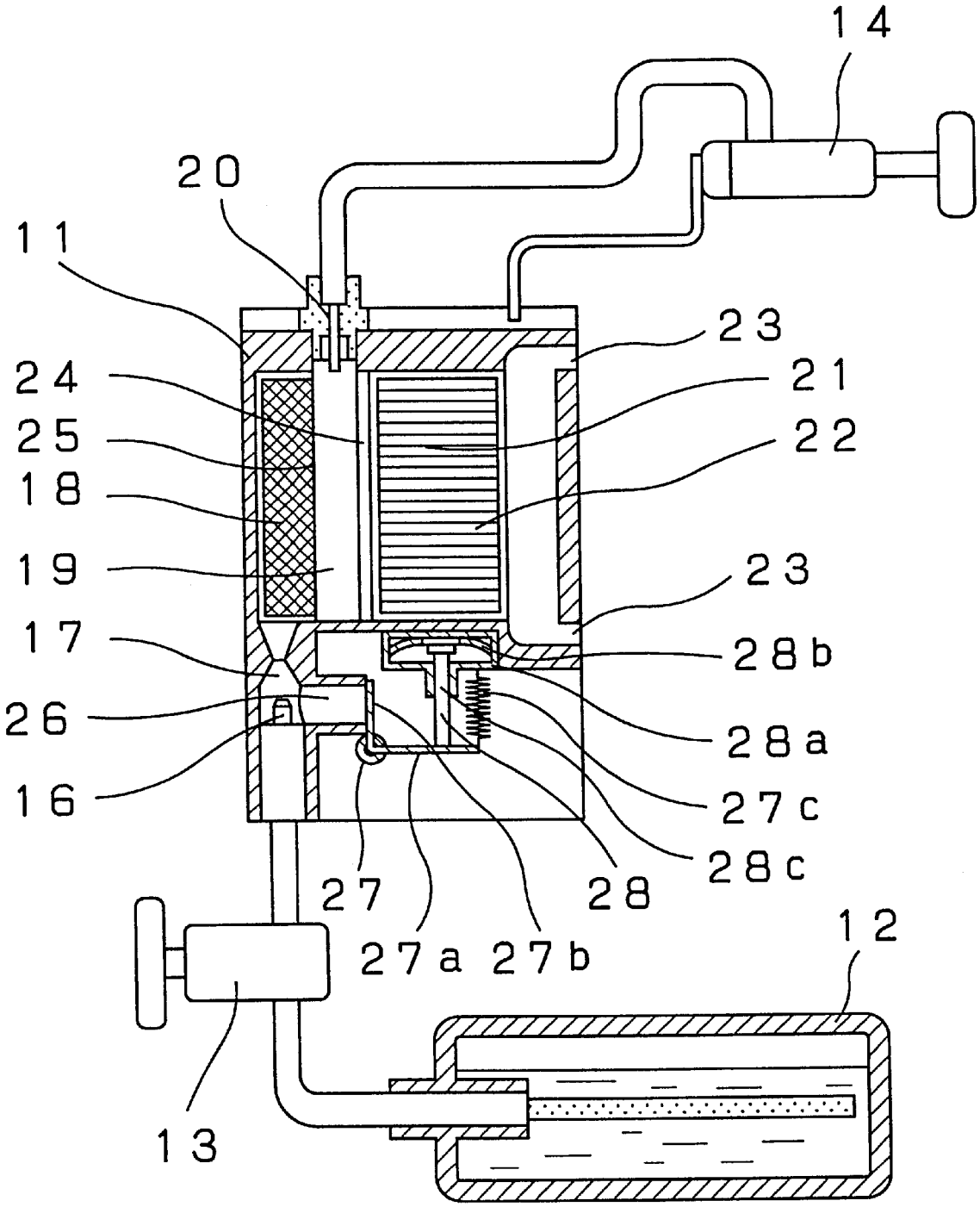
FIG. 2 is a cross-sectional view of the overall structure of a catalytic combustion apparatus in the first example of the present invention.
Figure 3:
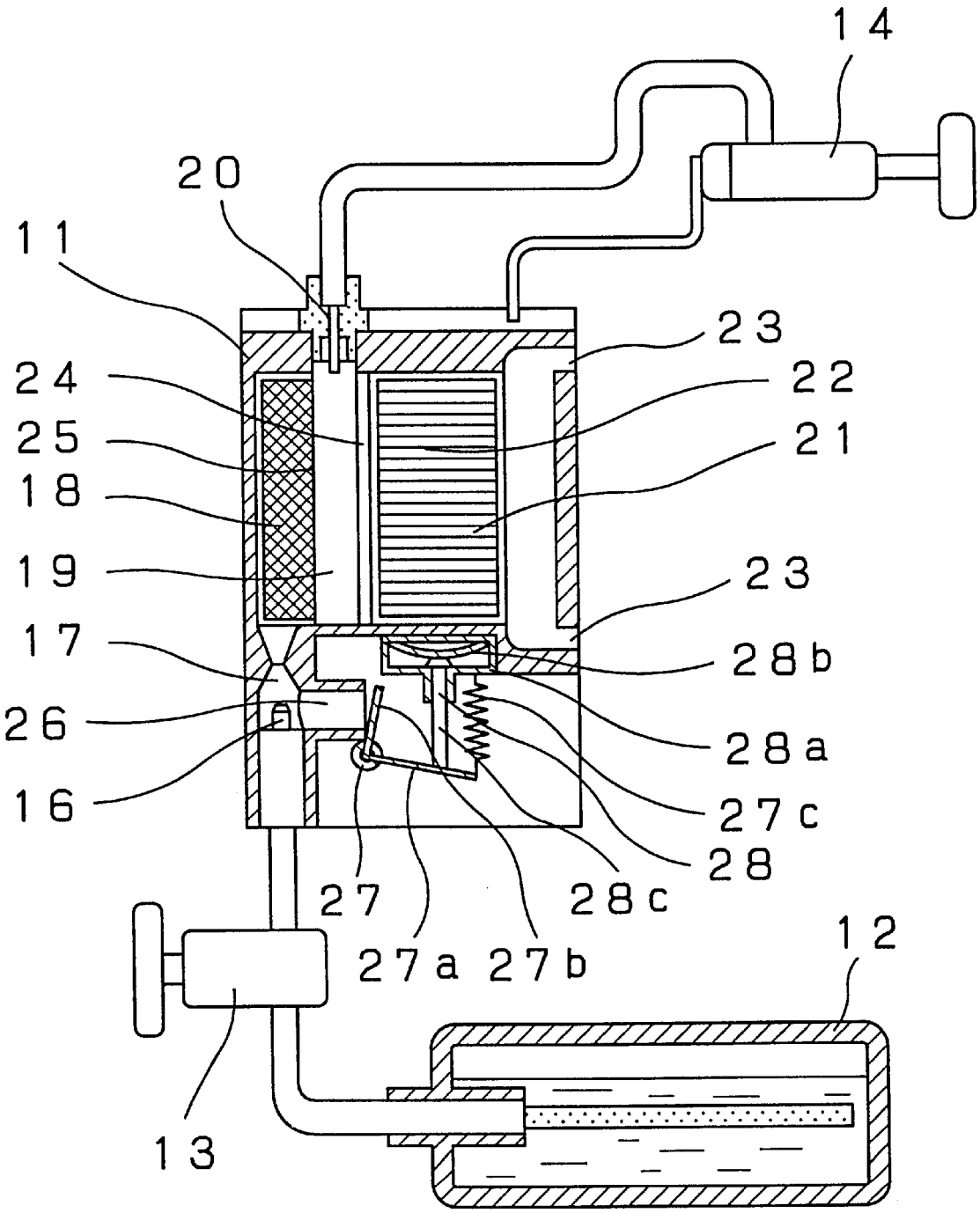
FIG. 3 is a cross-sectional view of the overall structure of a catalytic combustion apparatus in the first example of the present invention.

FIG. 2 and FIG. 3 are cross-sectional views to illustrate the overall structure of a catalytic combustion apparatus. Numeral 26 is an air intake. Numeral 27 is an air-intake shutter comprising an L-shaped shutter 27*a*, an aperture for air intake 27*b*, and a tension spring 27*c*. The size of the aperture for air intake is designed to a size at which the quantity of air necessary for forming a flame at the burner port without fail can be taken in. Numeral 28 is a temperature detecting means provided in the vicinity of the combustion chamber 21 and comprises a case 28*a*, a bimetal 28*b*, and an operating rod 28*c*. The remaining configuration is the same as in FIG. 1. The operating temperature of the temperature detecting means 28 is set at approximately 250 degrees C. which is slightly higher than the catalytic combustion enabling temperature. The catalyst for combustion 22 is heated by a flame formed at the burner port 25, and the temperature of the catalyst for combustion 22 rises in several seconds to 200 degrees C. or higher which is generally regarded as a catalytic combustion enabling temperature. As the heat capacity of the catalytic net 25*a* is small, its temperature instantly rises and catalytic combustion commences almost simultaneously on the catalytic net 25*a*, the flame formed on the burner port spontaneously disappears, and catalytic combustion commences on the catalyst for combustion 22. When the temperature of the catalyst for combustion 22 rises to 250 degrees C. which is higher than the catalytic combustion enabling temperature, the temperature detecting means 28 operates to open the air-intake shutter 27, the area of the aperture is increased, and the quantity of the intake air is increased. By making the air-to-fuel ratio higher after transition to catalytic combustion, the ratio of combustion on the catalytic net 25*a* is reduced by making the velocity of flow of mixed gas of the fuel gas and air faster, thereby lengthening the life of the catalytic net 25*a*. Furthermore, by increasing the air-to-fuel ratio, the temperature of the catalyst for combustion is also reduced thus enhancing durability.

Figure 4:
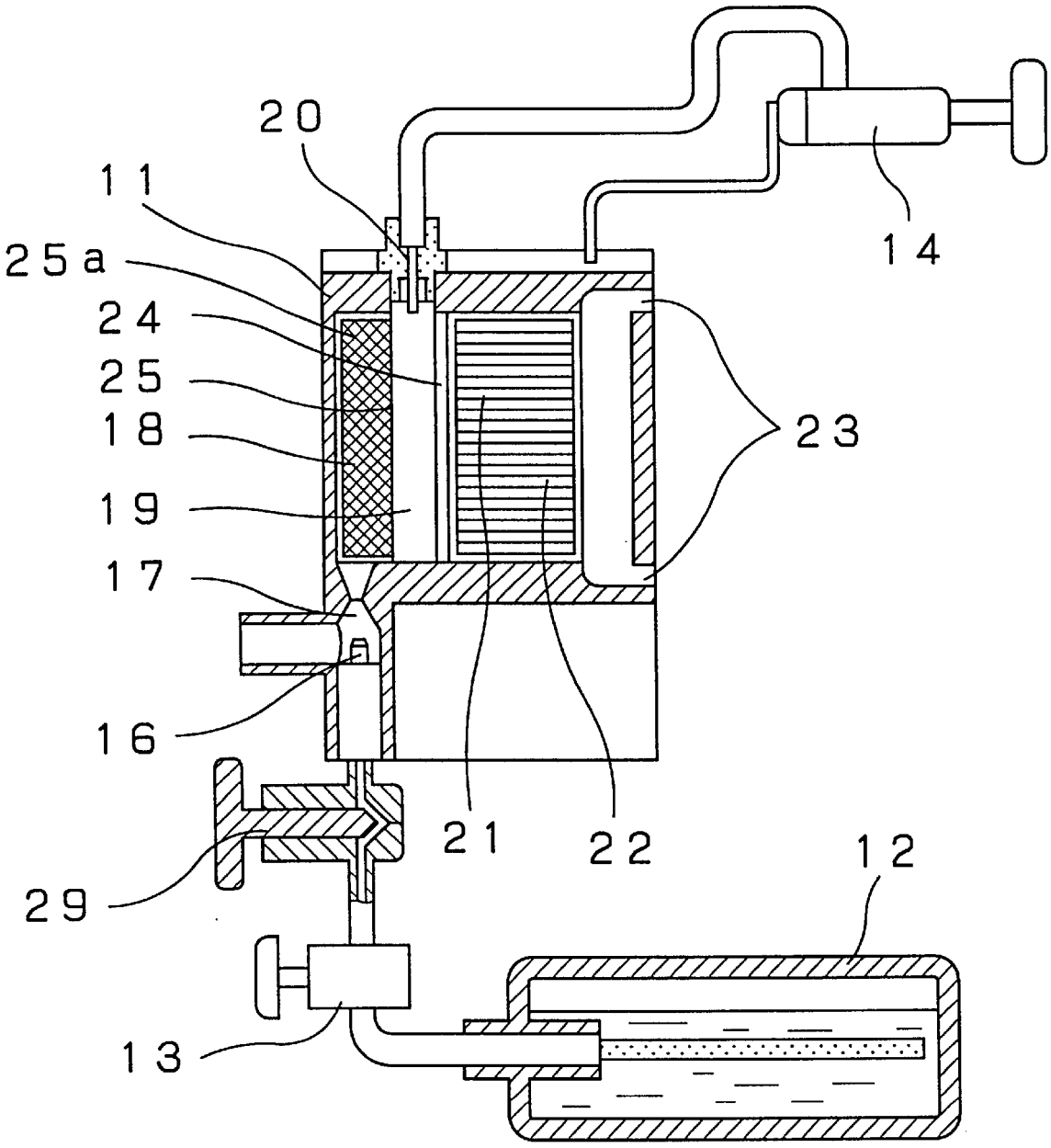
FIG. 4 is a cross sectional view of the structure of a combustor of a catalytic combustion apparatus in the first example of the present invention.

FIG. 4 is a cross-sectional view to illustrate a combustor of the catalytic combustion apparatus. Numeral 29 is a quantity-of-flow adjustable means such as a needle valve provided between a valve 13 and a combustor 11. The remaining structure is the same as the catalytic combustion apparatus in FIG. 1. When the quantity of flow of the fuel gas is reduced by controlling the quantity-of-flow adjustable means 29, as the generated heat is insufficient, catalytic combustion cannot be maintained on such a catalyst with a large heat capacity as the catalyst for combustion 22. However, as the heat capacity of the catalytic net 25*a* is small, catalytic combustion can be maintained even with a small amount of heat generation. Consequently, the adjustable range of the amount of combustion is widened by burning on the catalytic net 25*a* only when the flow rate is low, and burning on both the catalytic net 25*a* and the catalyst for combustion 22 when the flow rate of the fuel gas is increased.

Figure 5:
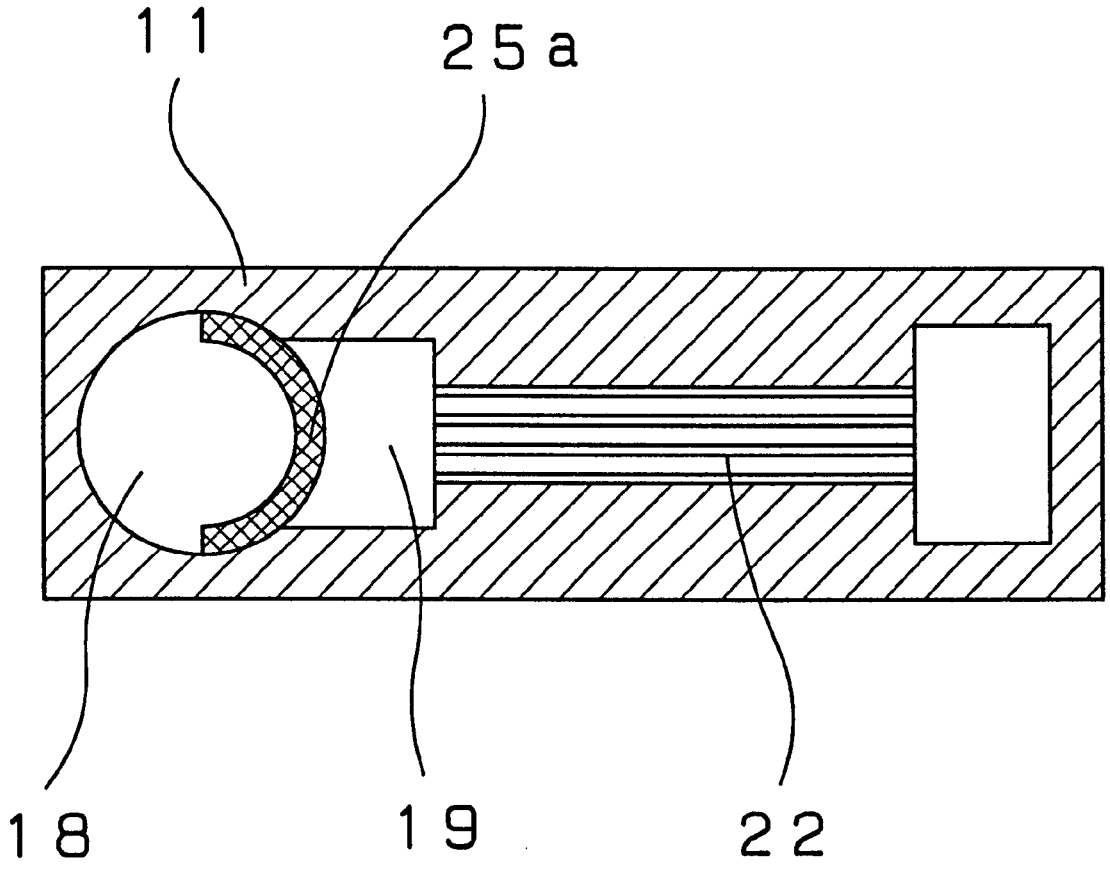
FIG. 5 is a cross-sectional view of an essential part of the combustor of a catalytic combustion apparatus in the first example of the present invention.

FIG. 5 is a cross-sectional view of an essential part of the combustion chamber of the catalytic combustion apparatus. Here, a mixing chamber 18 and a part of a catalytic net 25*a* are in contact with each other thereby to transfer heat of the catalytic net 25*a* to the combustor 11 through the wall of the mixing chamber 18, control the temperature rise of the catalytic net 25*a*, and lengthen the life of the catalytic net 25*a*.

Figure 6:
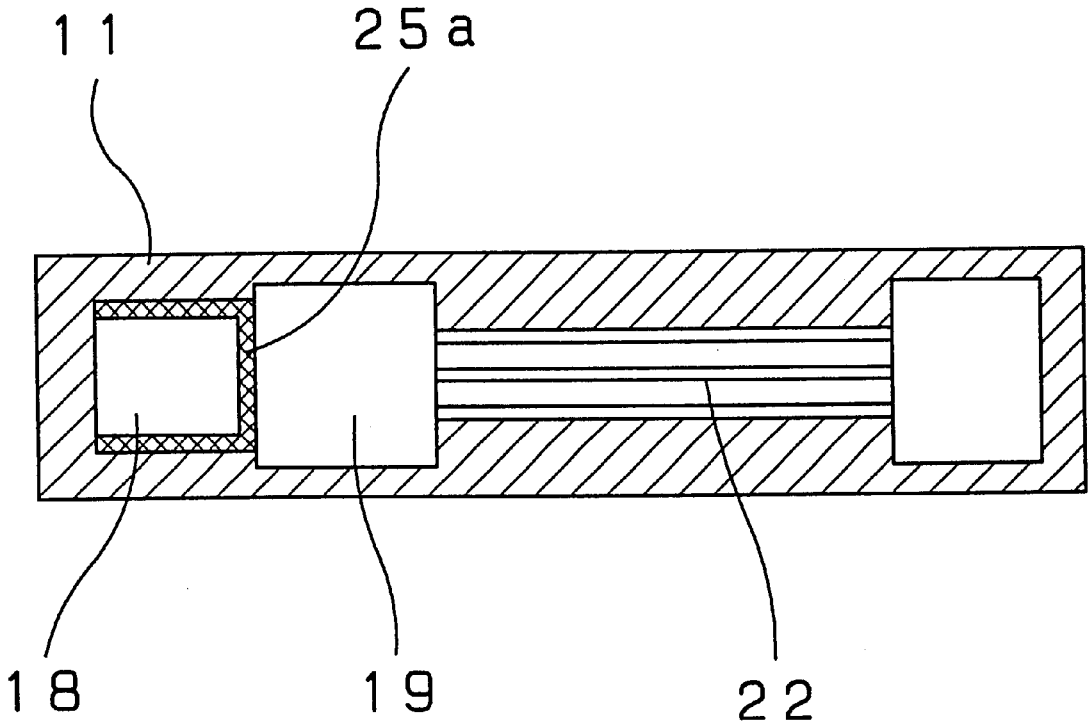
FIG. 6 is a cross-sectional view of an essential part of the combustor of a catalytic combustion apparatus in the first example of the present invention.

FIG. 6 is a cross-sectional view of an essential part of a combustion chamber of another example of a catalytic combustion apparatus. Numeral 11 is a straight cylindrical passage having a rectangular cross-section and numeral 25*a* is a catalytic net formed to the shape of a square letter C. Here, the above described catalytic net 25*a* is formed to the shape of a square letter C so that it comes into contact with the mixing chamber 18 on two sides. This way, the dispersion of the area of contact between the mixing chamber 18 and the catalytic net 25*a* during assembly work can be eliminated and stable characteristics can be obtained.

Figure 7:
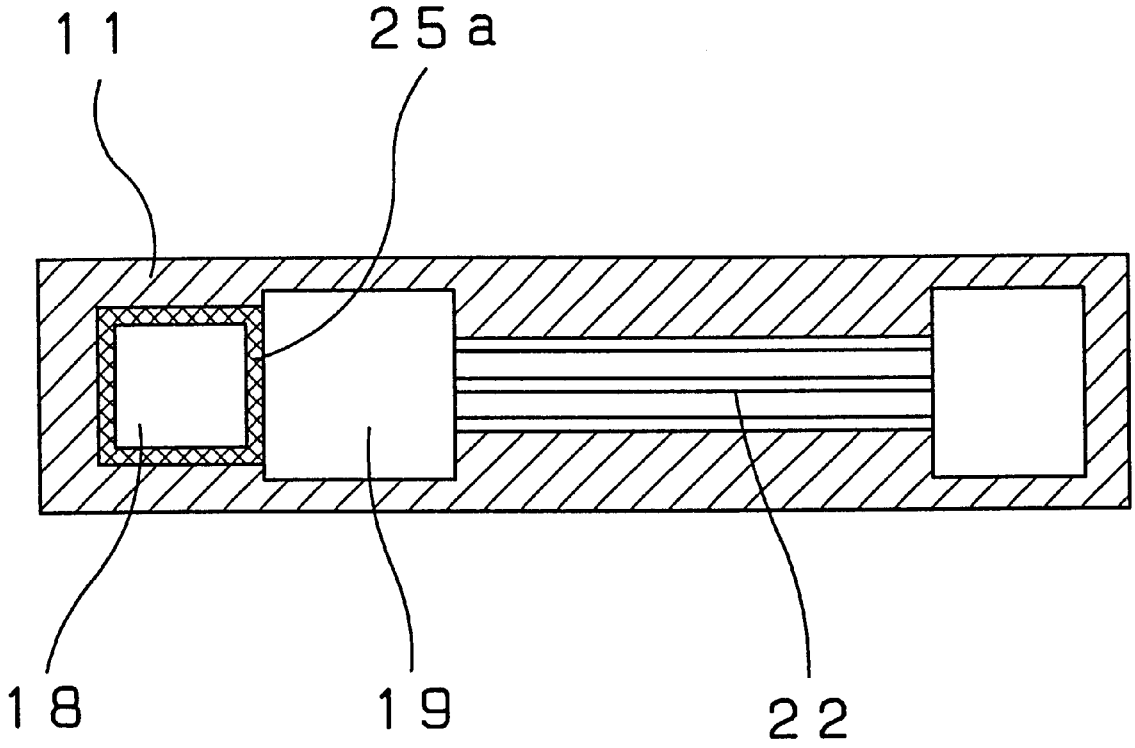
FIG. 7 is a cross-sectional view of an essential part of the combustor in the first example of the present invention.

FIG. 7 is a cross-sectional view of an essential part of a combustion chamber of still another example of a catalytic combustion apparatus. Numeral 11 is a straight cylindrical passage having a rectangular cross section and numeral 25*a* is a catalytic net formed to the shape of a square. Here, the catalytic net 25*a* is formed to the shape of a square so that it comes into contact with the mixing chamber 18 on three sides. This way, by making it easy to maintain the shape of the catalytic net 25*a*, the dispersion of the area of contact between the mixing chamber 18 and the catalytic net 25*a* during assembly work can be eliminated and further stabilized characteristic can be obtained.

Figure 9:
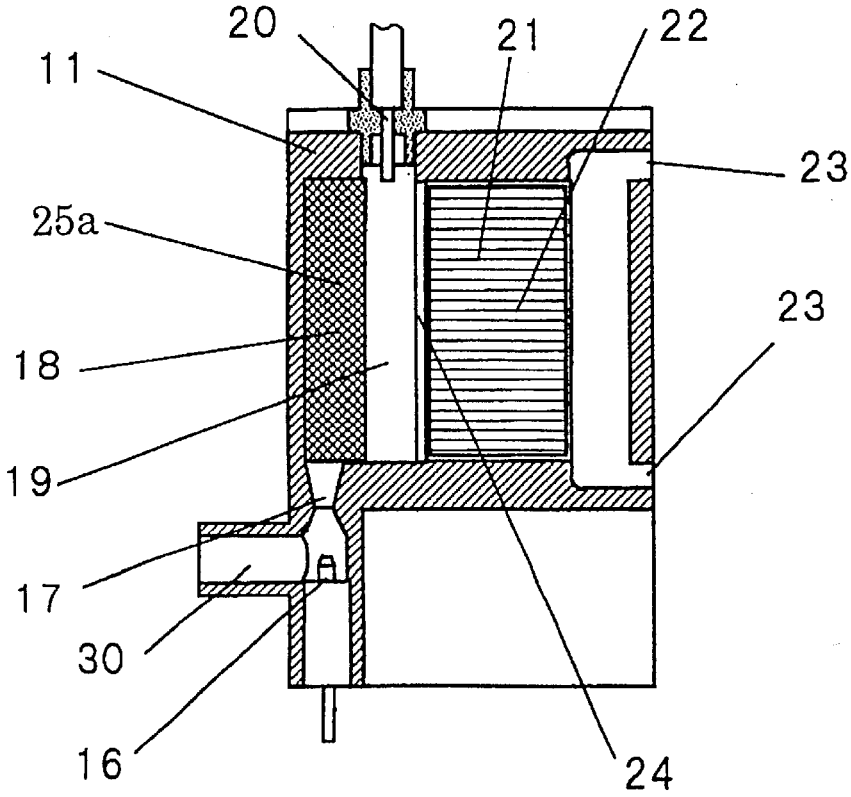
FIG. 9 is a cross-sectional view of the structure of a catalytic combustion apparatus in the first example of the present invention.

FIG. 9 is a cross-sectional view to illustrate the structure of a part of the catalytic combustion apparatus shown in FIG. 1 to FIG. 4. A catalytic net 25*a* is housed inside a mixing chamber 18. In other words, the catalytic net 25*a* is disposed on the upper part of the burner port 25 described in the first example. As the heat capacity of the catalytic net 25*a* is small and the temperature rises to a predetermined temperature in a short period of time, it has extremely high flame-keeping effect. Consequently, a flame once formed by ignition of a mixed gas will not disappear due to the flame-keeping effect of the above-mentioned catalytic net 25*a*.

As a result, according to this example, a flame can be formed on the catalytic net 25*a* without fail, transition to catalytic combustion can be effected without fail even when the combustion chamber 21 is configured thin, thereby realizing a downsized and thin catalytic combustion apparatus.

EXAMPLE—2

Figure 10:
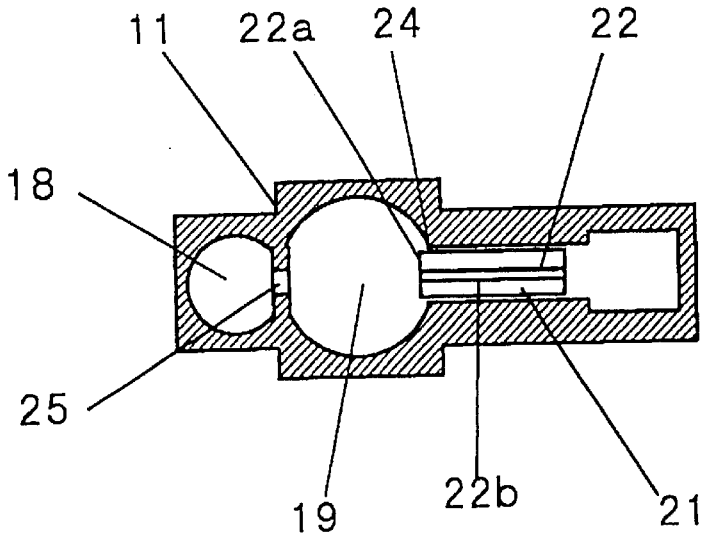
FIG. 10 is a cross-sectional view of an essential part of a catalytic combustion apparatus in a second example of the present invention.

Next, a description will be given of a second example. FIG. 10 is a cross-sectional view of an essential part of a catalytic combustion apparatus of this example. In this example, a portion 22*a* of a catalyst for combustion 22 is disposed in a manner such that it projects into a firing chamber 19.

Figure 8:
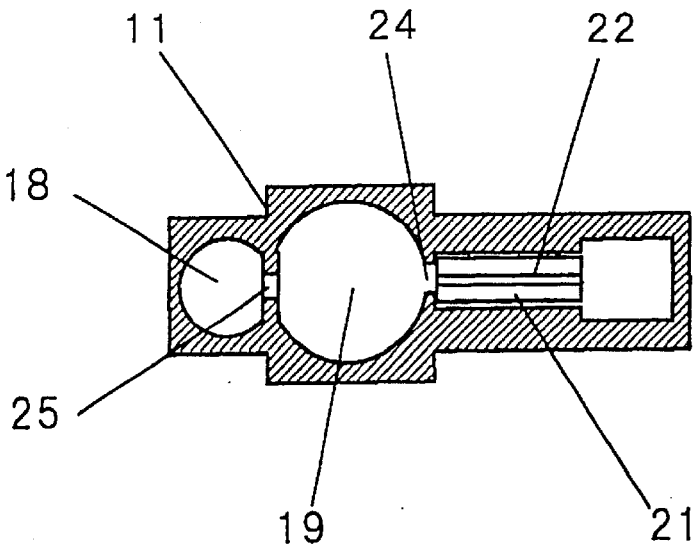
FIG. 8 is a cross-sectional view the structure of the combustor in the first example of the present invention.

In the first example, as illustrated in FIG. 8, the catalyst for combustion 22 is housed inside the combustion chamber 21. As the combustion chamber 21 is of dense structure, the heat capacity is large and it takes time for the catalyst for combustion 22 to reach a predetermined temperature. In contrast to this, in the present embodiment, the portion 22*a* of the catalyst for combustion 22 is disposed in a manner such that it projects into the firing chamber 19 as described above. Most of the firing chamber 19 is an empty space with an extremely small heat capacity compared with that of the combustion chamber 21. Accordingly, in this example, the time during which the catalyst for combustion 22 reaches a predetermined temperature is made shorter by disposing a portion 22*a* of the catalyst for combustion 22 inside the firing chamber 19 with a small heat capacity.

As has been described above, according to this example, the speed of transition to catalytic combustion can be made faster by making the rate of temperature rise of the catalyst for combustion 22 higher thereby realizing a downsized and thin catalytic combustion apparatus.

EXAMPLE—3

Figure 11:
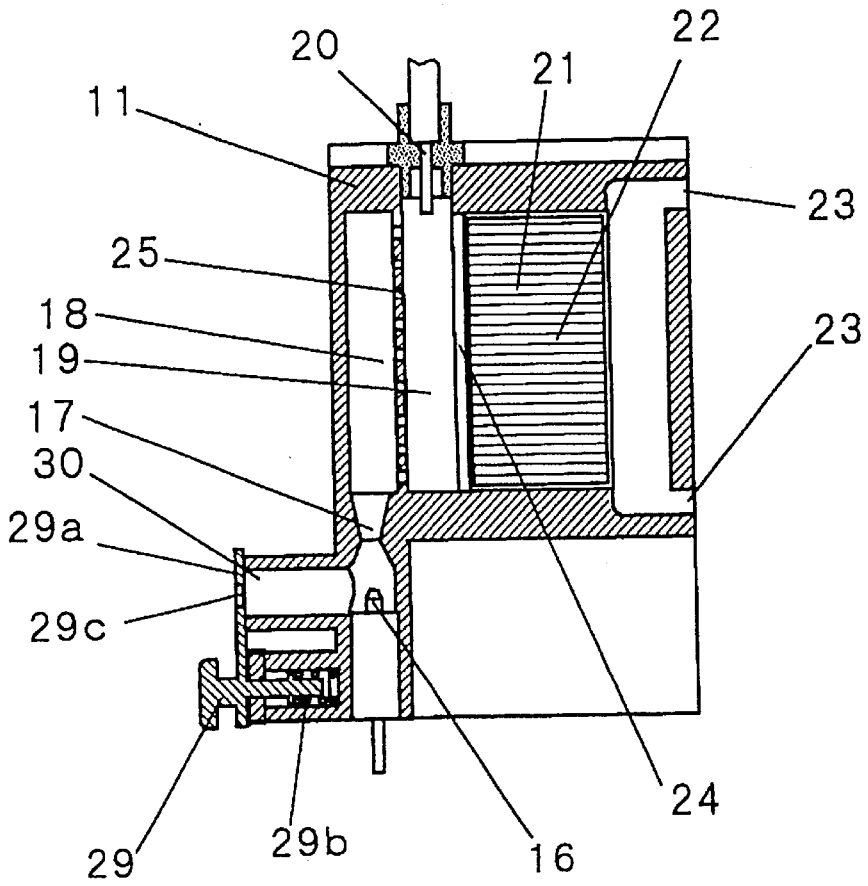
FIG. 11 is a cross-sectional view of an essential part of a catalytic combustion apparatus in a third example of the present invention.

Next, a description of a third example of the present invention will be given. FIG. 11 is a cross-sectional view of a combustor 11 of a catalytic combustion apparatus in this example. In this example, a quantity-of-flow adjustable means 29 is provided on an air intake 30. The quantity-of-flow. adjustable means comprises an opening/closing lid 29*a* and an opening/closing spring 29*b*. On the opening/closing lid 29*a*, an opening 29*c* which is smaller than the open area of the air intake 30 is provided. The size of the opening 29*c* is designed in a manner such that an optimum quantity of air for ignition can be taken in.

In other words, when a user depresses the quantity-of-flow adjustable means 29 with a finger, the opening/closing lid 29*a* overcomes the pressure of the opening/closing spring 29*b* and covers the surface of the air intake 30. As a result, the air to be taken in by an air intake/ejector 17 goes through the opening 29*c* which is provided on the opening/closing lid 29*a*. In this way, when igniting, the air intake/ejector 17 takes in a small quantity of air thereby to supply a mixed gas with a low excess air ratio to a mixing chamber 18. The mixed gas with low excess air is easily fired meaning that firing can be done without fail. When the user releases the finger from the quantity-of-intake-air adjustable means 29 after firing has been done in this way, the opening/closing lid 29*a* is detached from the surface of the air intake 30 by the pushing force of the opening/closing spring 29*b*. That is, the air to be taken in by the air intake/ejector 17 during catalytic combustion goes through the air intake 30. Consequently, during catalytic combustion, the air intake/ejector 17 supplies to the mixing chamber 18 a mixed gas with a high excess air ratio by taking in a large amount of air.

As has been described above, in the third example, the amount of air in the mixed gas can be set at an optimum excess air ratio for each of firing and catalytic combustion thereby providing a downsized and thin catalytic combustion apparatus having a superior combustion characteristic of catalytic combustion.

EXAMPLE—4

Figure 12:
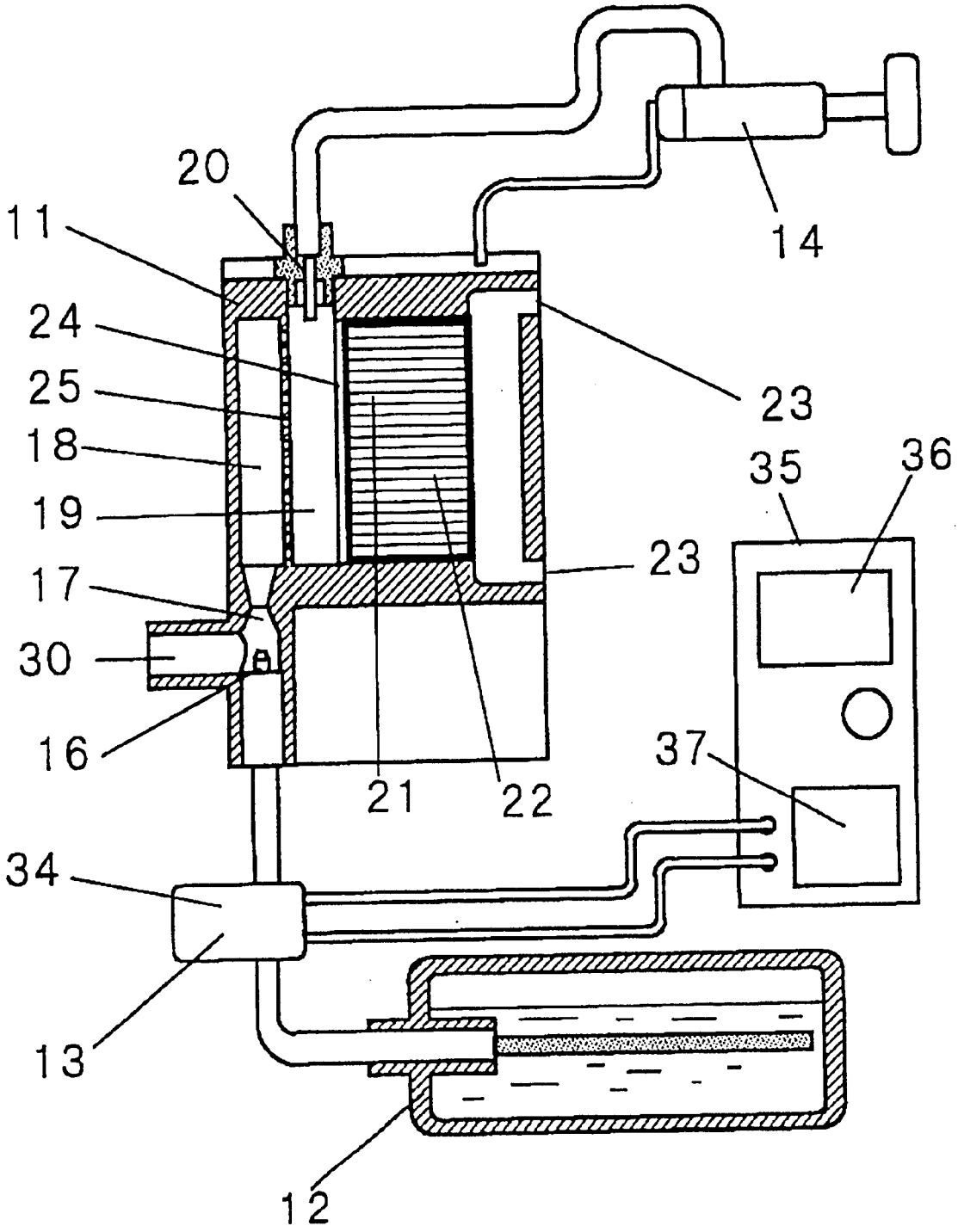
FIG. 12 is a cross-sectional view of the overall structure of a catalytic combustion apparatus in a fourth example of the present invention.

A description of a fourth example of the present invention will now be given. FIG. 12 is a cross-sectional view to illustrate the overall structure of a catalytic combustion apparatus of this example. In this example, the valve as described in each of the above-described examples comprises a solenoid valve 34 and a control apparatus 35. The control apparatus 35 further comprises a timer circuit 36 and a relay circuit 37.

To be more specific, in this example, the apparatus is controlled in a manner such that the solenoid valve 34 is temporarily closed by the timer circuit 36 and the relay circuit 37 for a certain period of time after an ignition device 14 has operated, and is reopened after a predetermined period of time has elapsed. Adoption of the above configuration enables extinction of a flame without fail after a catalyst for combustion 22 has been heated and stable transition to catalytic combustion occurs.

As has been described above, according to the fourth example, stable transition to catalytic combustion is enabled and a downsized and thin catalytic combustion apparatus is realized.

EXAMPLE—5

Figure 13:
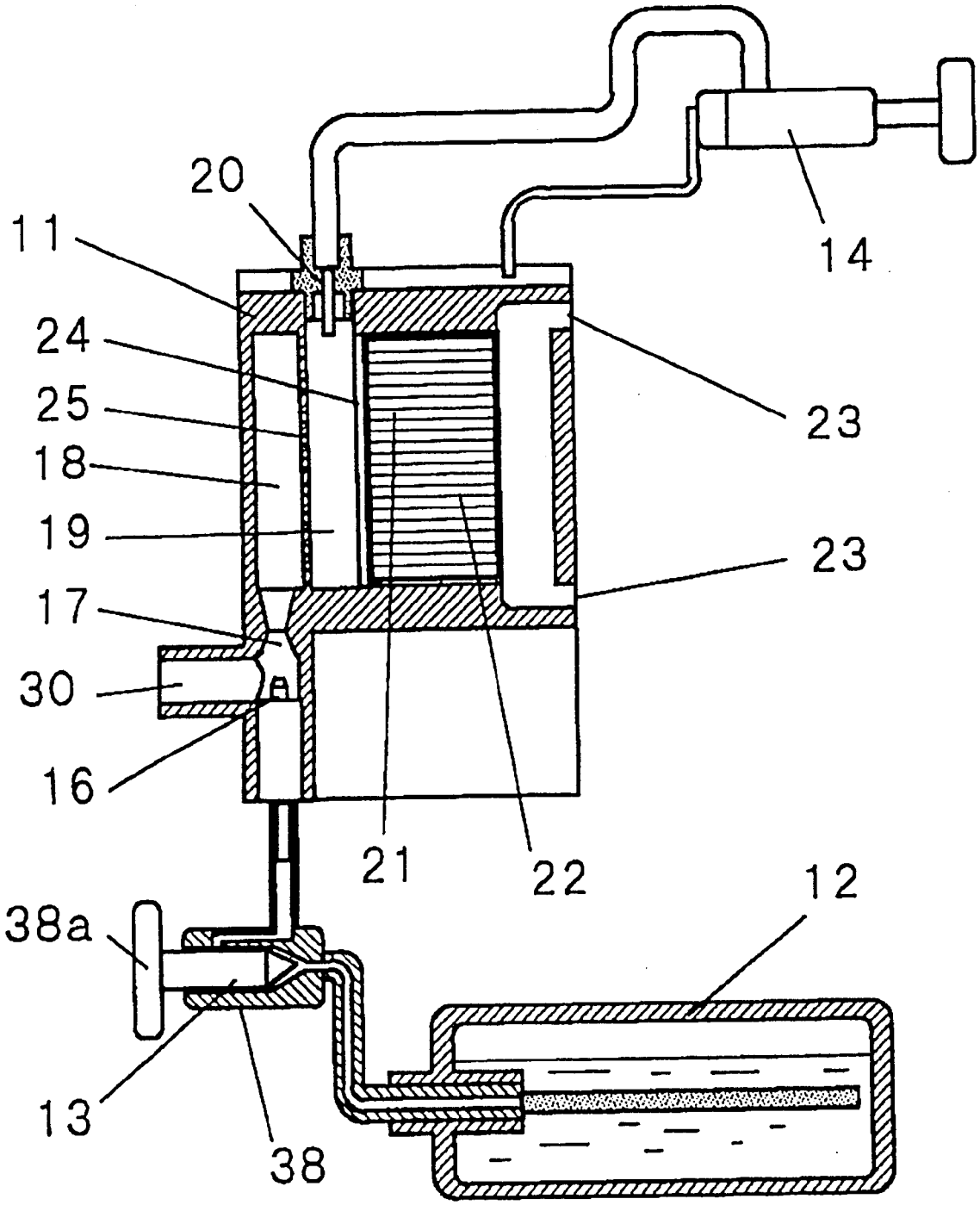
FIG. 13 is a cross-sectional view of the overall structure of a catalytic combustion apparatus in a fifth example of the present invention.

Next, a description will be given of a fifth example of the present invention. FIG. 13 is a cross-sectional view to illustrate the overall structure of a catalytic combustion apparatus of this example. In this example, a quantity-of-flow adjustable means 38 is provided on a valve 13. The quantity-of-flow adjustable means 38 has a cock 38*a*. In this example, by manually opening and closing the cock 38*a*, the quantity of fuel gas to be supplied from a fuel tank 12 can be adjusted.

To be more specific, the cock 38*a* is fully opened when igniting so as to make the quantity of the fuel gas to be supplied from the fuel tank 12 the maximum, thereby lowering the excess air ratio and making ignition easy. When ignition is finished, the quantity of the fuel gas to be supplied from the fuel tank 12 is reduced by closing the cock 38*a* thereby increasing the excess air ratio. As a result, the flame spontaneously disappears and transition to catalytic combustion is quickly effected.

In the fifth example, as has been described above, a downsized and thin catalytic combustion apparatus is realized in which the valve 13 has a quantity-of-flow adjustable means 38, and ignition is made by operating the ignition device 14 while fully opening the quantity-of-flow adjustable means. Subsequently, by operating the quantity-of-flow adjustable means to control the quantity of supply of the fuel gas, stable transition to catalytic combustion is effected without fail.

EXAMPLE—6

Figure 14:
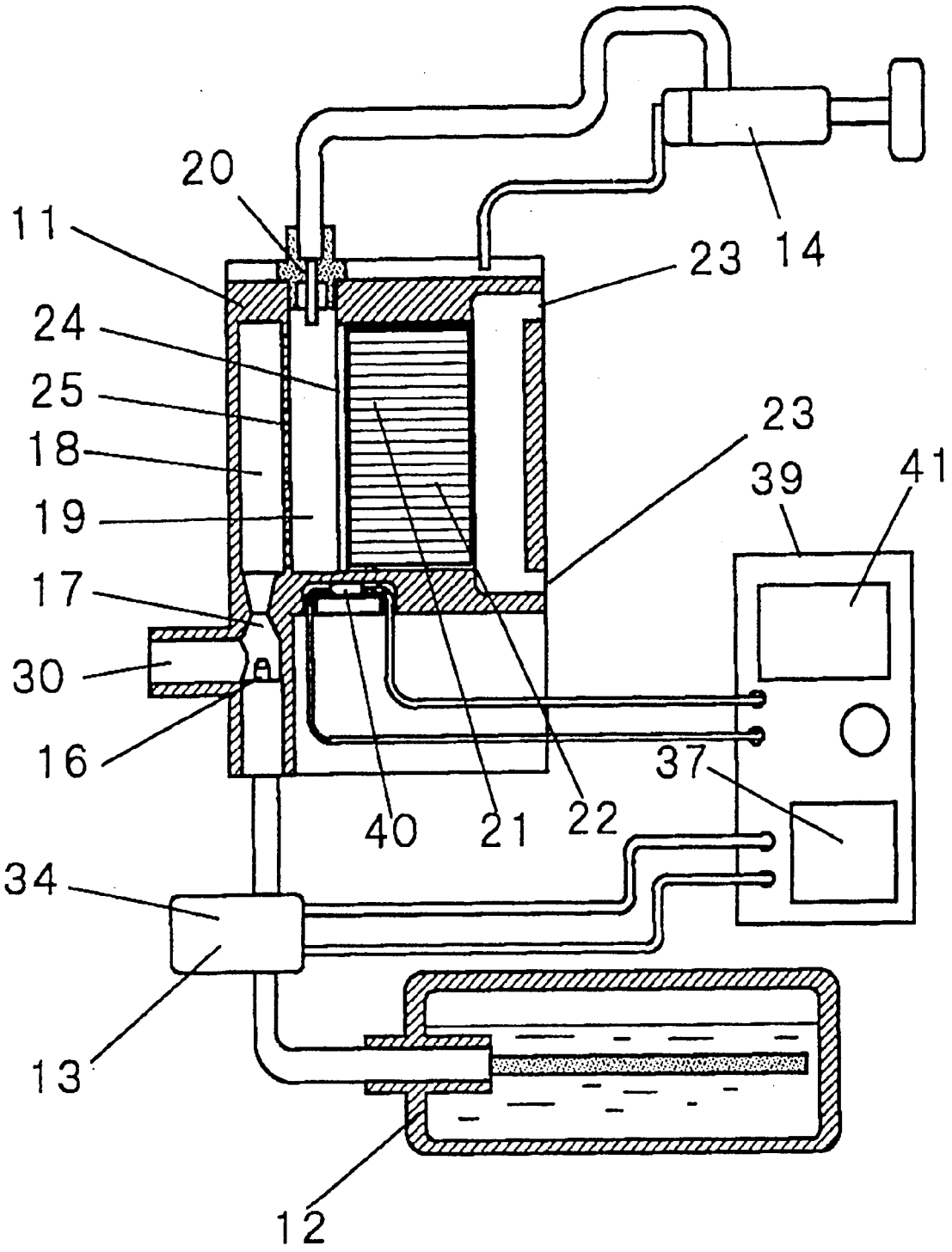
FIG. 14 is a cross-sectional view of the overall structure of a catalytic combustion apparatus in a sixth example of the present invention.

A description of a sixth example of the present invention will now be given. FIG. 14 is a cross-sectional view to illustrate the overall structure of a catalytic combustion apparatus of this example. In this example, a temperature detecting means 40 is provided in a combustion chamber 21. A thermistor is used as the temperature detecting means 40 in this example. Detected temperature information from the temperature detecting means 40 is transmitted to a control apparatus 39. The control apparatus 39 has a relay circuit 37 and a temperature detecting circuit 41.

Upon detecting that the temperature of a catalyst for combustion 22 has reached a catalytic combustion enabling temperature based on the detected temperature information from the temperature detecting means 40, the control apparatus 39 controls a solenoid valve 34 so it is temporarily closed. As a result, the fuel gas supplied from a fuel tank 12 is suspended at the time the temperature of the catalyst for combustion 22 has reached the catalytic combustion enabling temperature. Accordingly, the flame burning in a firing chamber 19 is automatically extinguished thereby assuring transition to catalytic combustion.

As has been described above, according to the sixth example, by constituting a valve 13 from the solenoid valve 34 and the control apparatus 39, and controlling the control apparatus 39 so that the solenoid valve 34 is temporarily closed by a signal from the temperature detecting means disposed in the combustion chamber 21, a downsized and thin catalytic combustion apparatus is realized in which ignition and transition to catalytic combustion are performed with stability and certainty.

EXAMPLE—7

Figure 15:
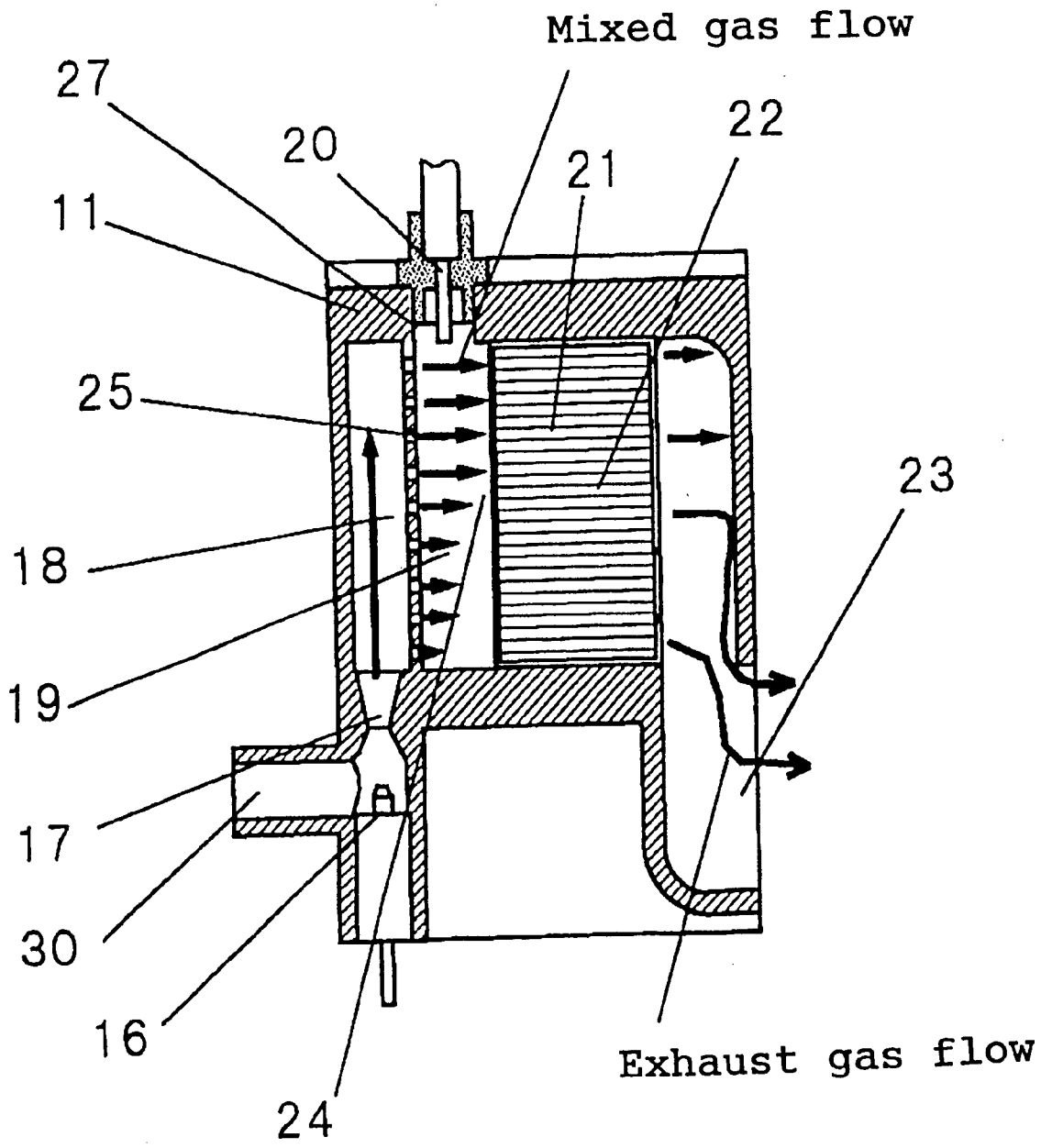
FIG. 15 is a cross-sectional view of the structure of a combustor of a catalytic combustion apparatus in a seventh example of the present invention.

Next, a description of a seventh example of the present invention will be given. FIG. 15 is a cross-sectional view of a combustor of a catalytic combustion apparatus of this example. In this example, an exhaust port 23 is provided on the combustor 11 at a position not overlapping a combustion chamber 21 and displaced in a direction opposite the direction of ejection of a mixed gas to a mixing chamber 19.

As a result, the exhaust gas produced by catalytic combustion and to be exhausted from the exhaust port 23 will reach the exhaust port 23 while making contact with the combustion chamber 21. In other words, as the amount of heat of the exhaust gas is absorbed by the combustion chamber 21, or is used to increase the temperature of the combustion chamber 21, the temperature of the exhaust gas is reduced. Furthermore, in the configuration of the present example, that portion of the mixed gas which is powerful is made far from the exhaust port 23 and that portion of the mixed gas which is weak is made near to the exhaust port 23 thereby allowing the mixed gas to uniformly pass through a catalyst for combustion 22.

As has been described above, in the configuration of the seventh example, by disposing the exhaust port 23 in the combustion chamber 21 at a position not overlapping the combustion chamber 21 and opposite to the direction of the mixed gas ejected into the mixing chamber 19, a downsized and thin catalytic combustion apparatus is obtained in which a mixed gas uniformly passes through a catalyst for combustion thereby assuring uniform catalytic combustion.

EXAMPLE—8

Figure 16:
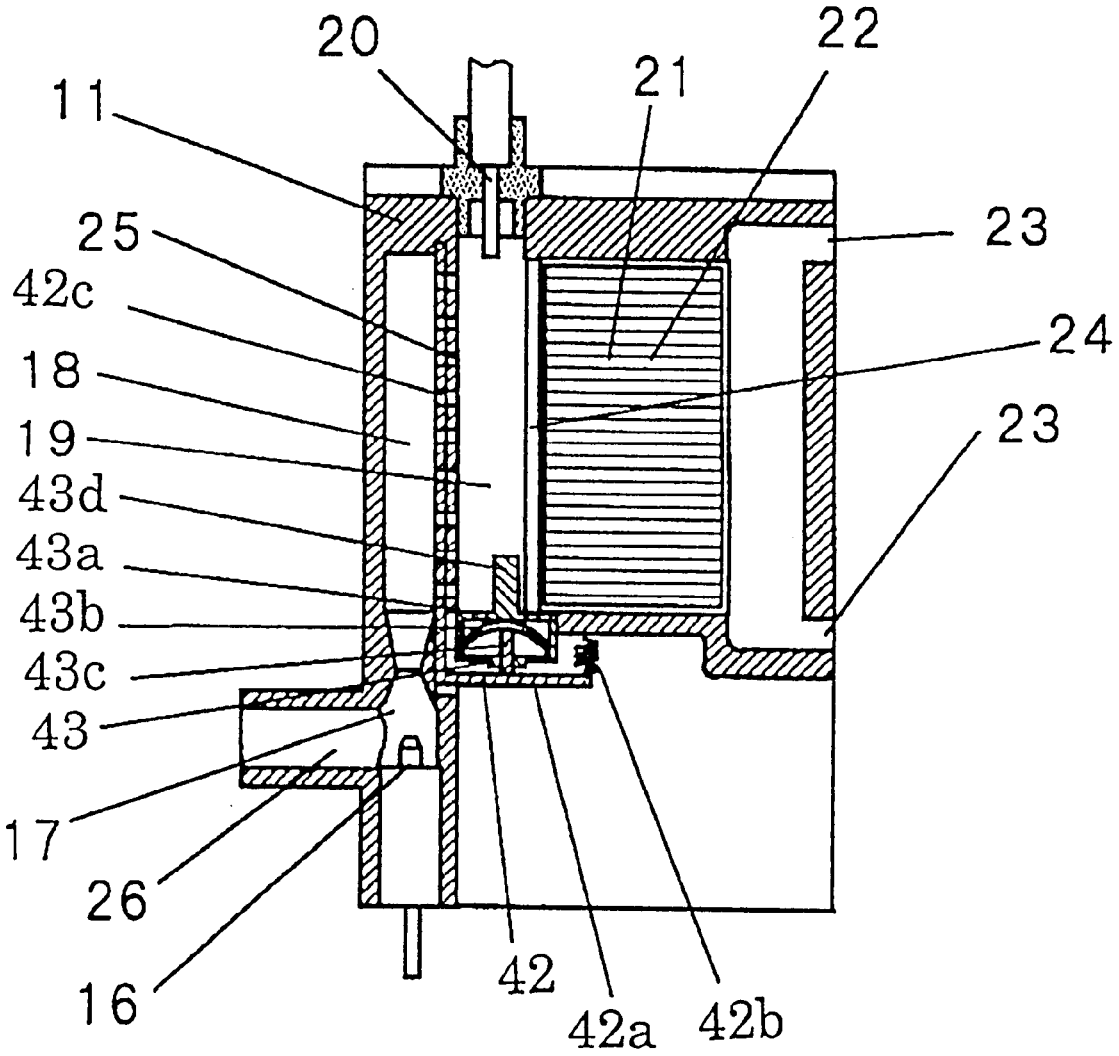
FIG. 16 is a cross-sectional view of the structure of a combustor of a catalytic combustion apparatus in an eighth example of the present invention.

Next, a description of an eighth example of the present invention will be given. FIG. 16 is a cross-sectional view to illustrate the structure of a combustor of this example. In this example, a combustor 11 has a burner port area adjustable means 42 for adjusting the area of a burner port 25. Also, the burner port area adjustable means 42 is operable with a signal from a temperature detecting means 43 provided in the vicinity of the burner port 25. The burner port area adjustable means 42 comprises an L-shaped adjustable plate 42 and a tension spring 42*b*. On the adjustable plate 42 are provided the same number and size of adjustable holes 42*c* as that of the burner port 25. Also, the temperature detecting means 43 comprises a case 43*a*, a bimetal 43*b* and an operating rod 43*c*. A heat sensing rod 43*d* is secured to the case 43*a* for better exposure to the heat of a flame formed on the burner port 25. The adjustable plate 42*a* is positioned in such a way that the positions of the adjustable hole 42*c* and the burner port 25 agree when there is no flame.

Figure 17:
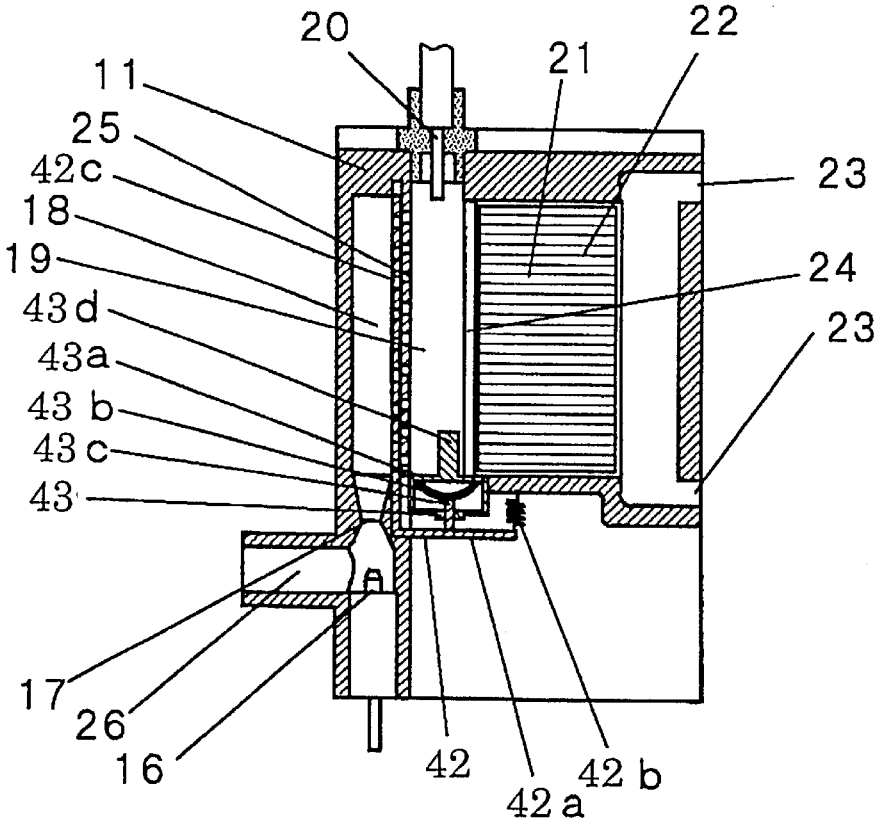
FIG. 17 is a cross-sectional view of a state in which a burner port area adjustable means is in operation in the eighth example of the present invention.

Next, operation of this example will be described. When a flame is formed on the burner port 25, temperature of a catalyst for combustion 22 rises to a catalytic combustion enabling temperature. At the same time, the temperature of the heat sensing rod 43*d* constituting the temperature detecting means 43 rises by the flame and conducts the amount of heat to the bimetal 43*b*. When the bimetal 43*b* flips over on receiving the amount of heat as shown in FIG. 17, the operating rod 43*c* also moves. As the operating rod 43*c* moves, the adjustable plate 42*a* which is in contact with the operating rod 43*c* also moves. When the adjustable plate 42*a* moves, the position of the adjustable holes 42*c* also moves thereby displacing the positions of the adjustable holes 42*c* and the burner port 25. In other words, the area of the aperture of the burner port 25 is reduced. When the area of the aperture of the burner port 25 is reduced, the flame formed on the burner port 25 disappears. Consequently, the catalyst for combustion 22 can easily shift to catalytic combustion. Also, when the flame disappears, the temperature of the heat sensitive rod 43*d* decreases, the bimetal 43*d* flips back again, and the adjustable plate 42*a* returns to its original position by the restoring force of the tension spring 42*b*.

As has been described above, in this example, the catalyst for combustion 22 can instantaneously start catalytic combustion.

EXAMPLE—9

Figure 18:
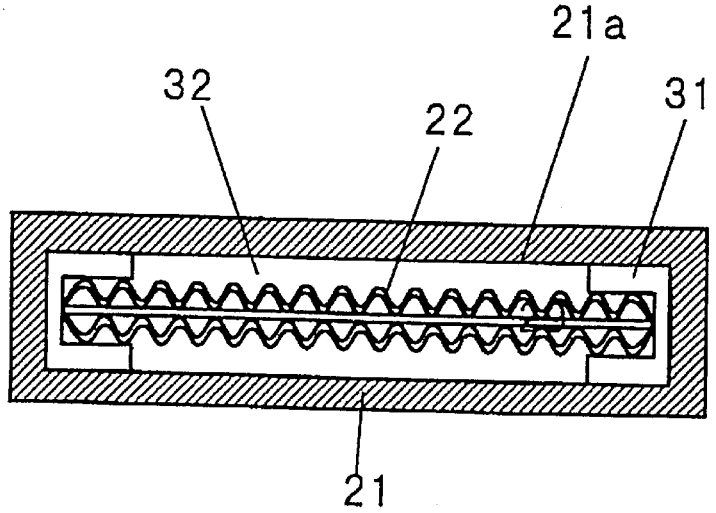
FIG. 18 is a cross-sectional view of the structure of a combustion chamber of a catalytic combustion apparatus in a ninth example of the present invention.

Next, a description will be given of a ninth example of the present invention. FIG. 18 is a cross-sectional view to illustrate the structure of a combustor of this example. In this example, a catalyst for combustion 22 is affixed in a combustion chamber 21 with a space 32 between itself and the inner wall of the combustion chamber 21. To be more specific, it is affixed between a pair of square C-shaped spacers 31 provided on the inner wall 21*a* of the combustion chamber 21.

By employing the above configuration, the amount of heat generated by the catalyst for combustion 22 is kept inside the combustion chamber 21. That is, as the heat is retained by the layer of air existing in the space 32, the heat of catalytic combustion is made difficult to be conducted to the inner wall 21*a*. As a result, the temperature of the outer wall of the combustion chamber 21 is controlled to a low level even when the apparatus is downsized thereby providing an easy-to-use catalytic combustion apparatus.

EXAMPLE—10

Figure 19:
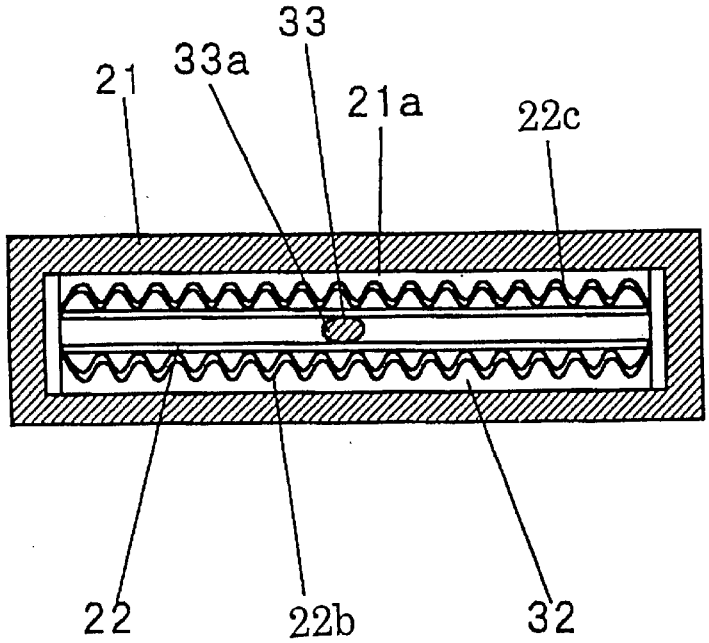
FIG. 19 is a cross-sectional view of the structure of a combustion chamber of a catalytic combustion apparatus in a tenth example of the present invention.
Figure 20:
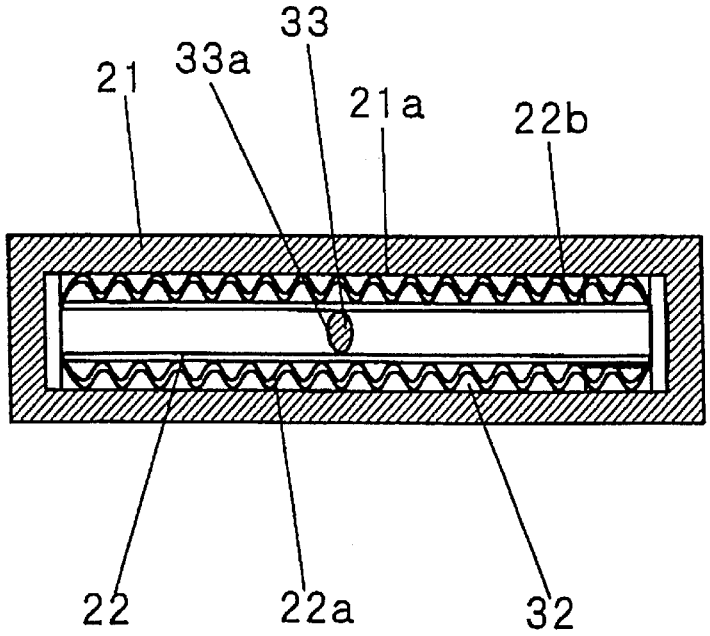
FIG. 20 is a cross-sectional view of a state in which a thickness adjustable means is in operation in a catalytic combustion apparatus in the tenth example of the present invention.

Next, a description of a tenth example of the present invention will be given. FIG. 19 and FIG. 20 are cross-sectional views to illustrate the configurations of a combustion chamber of this example. In this example, a catalyst for combustion 22 is provided with a thickness adjustable means 33. The thickness adjustable means 33 is composed of a pillar-shaped adjustable rod 33*a* having an oval cross-section. In this example, the catalyst for combustion 22 comprises two catalysts, namely, a first catalyst 22*b* and a second catalyst 22*c* disposed in a manner such that the adjustable rod 33*a* is sandwiched between them. When the major axis of the adjustable rod 33*a* is in the horizontal direction, the thickness of the catalyst for combustion 22 becomes thin as illustrated in FIG. 19, whereas, when in the vertical direction, the thickness becomes thick as illustrated in FIG. 20. In this way, the thickness of the catalyst for combustion 22 can be freely varied by rotating the adjustable rod 33*a*.

Consequently, according to the tenth example, the quantity of heat generated by the catalyst for combustion 22 and conducted to a combustor 11 can be adjusted by adjusting the space 32 between the inner wall 21*a* of a combustion chamber 21 and the catalyst for combustion 22 thereby providing a catalytic combustion apparatus with a wide temperature control range.

EXAMPLE—11

Figure 21:
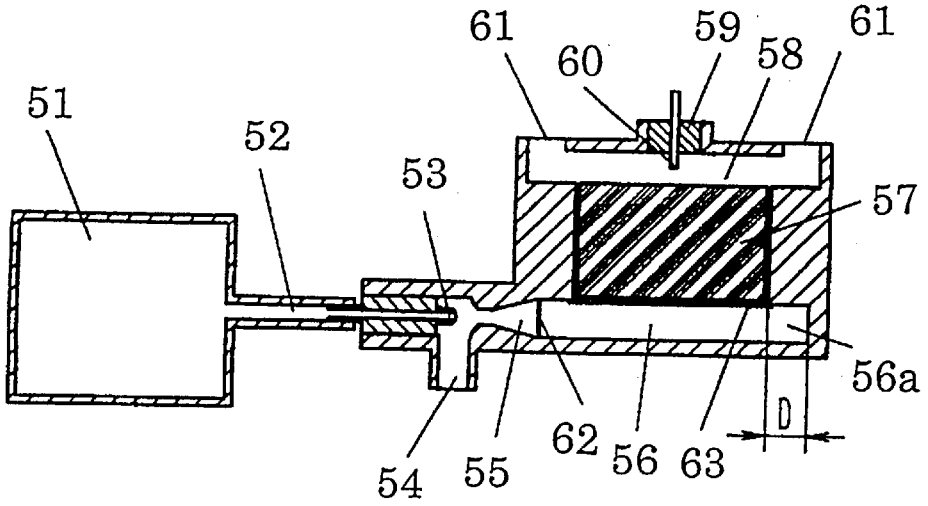
FIG. 21 is a cross-sectional view of the structure of a catalytic combustion apparatus in an eleventh example of the present invention.

A description of an eleventh example of the present invention will be given in the following. FIG. 21 is a cross-sectional view to illustrate a catalytic combustion apparatus of this example. Numeral 51 is a gas tank for storing liquefied petroleum gas such as butane and propane. A fuel gas inside the gas tank 51 is ejected from a gas nozzle 53 via a gas passage 52. A valve (not shown) for adjusting quantity of gas flow is provided between the gas tank 51 and the gas nozzle 53. The fuel gas ejected from the gas nozzle 53 draws in air from an air intake 54 by the ejection effect of the gas flow and is mixed with air in a mixing chamber 55. The exit of the mixing chamber 55 communicates with a straight cylindrical gas passage 56. A side of the straight cylindrical gas passage 56 communicates with a combustion chamber 58 which has a catalytic body 57. In this example, the combustion chamber 58 is disposed inside the straight cylindrical gas passage 56. In other words, an end portion of the combustion chamber 58 is positioned at a distance D inward from an end portion of a straight cylindrical gas passage 56.

Figure 22:
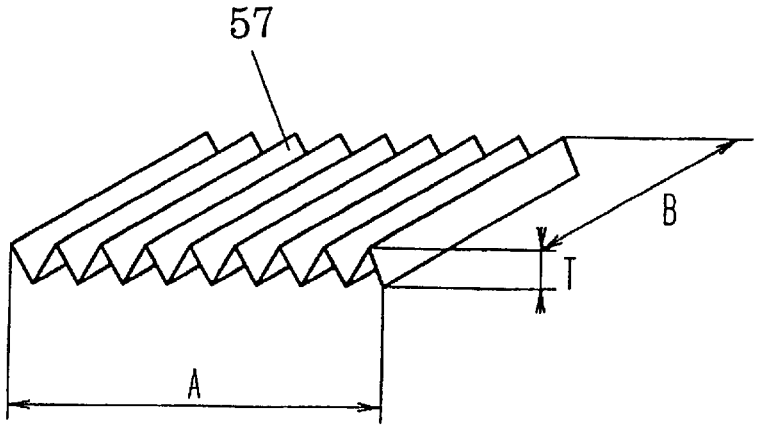
FIG. 22 is a perspective view to illustrate the structure of a catalytic body employed in a catalytic combustion apparatus in the eleventh example of the present invention.

The catalytic body 57 is of a configuration as illustrated in FIG. 22. FIG. 22 is a perspective view to illustrate the shape of a catalytic body used in this exemplary example. To be more specific, a continuously corrugated thin sheet of metal consisting of stainless steel or the like is used as the carrier of the catalyst. In this example, a platinum group metal or an oxide of metals such as nickel, cobalt, iron, manganese, or chromium is used as the catalyst. Especially preferable is a platinum group metal such as platinum, palladium, or rhodium. As illustrated in FIG. 22, the catalytic body 57 is formed in the shape of a flat plate in a manner such that the planar area as represented by width A×length B is greater than the side area as represented by width T×thickness B. In the eleventh example, this catalyst carrier can be easily formed by processing a 0.05 to 0.1 mm thick stainless steel foil, for example. In other words, the catalyst carrier is one which is easy to continuously process and is superior in mass producibility. Furthermore, as the catalyst carrier is of a continuous corrugated configuration, a large surface area per unit volume is obtainable. That is, improvement in catalytic performance can be expected.

Figure 23:
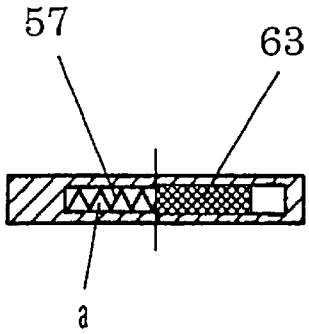
FIG. 23 is a cross-sectional view of the section housing the catalytic body in the catalytic combustion apparatus in the eleventh example of the present invention.

FIG. 23 is a cross-sectional view of a section housing the above described catalytic body 57. When the catalytic body 57 is housed in the combustion chamber 58, the corrugated portion "a" functions as a gas passage. In other words, the combustion gas flows sideways passing this gas passage (hereafter called gas passage "a"). Also, the combustion gas undergoes catalytic combustion while it passes the gas passage "a".

Also, as illustrated in FIG. 21, an ignition device 59 is provided on the side opposite to the entrance of the combustion chamber 58. When starting, the ignition device 59 is operated to generate a spark on a plug 60 on the tip. A flame is formed downstream of the catalytic body 57 by the spark, and the catalytic body 57 is heated by the flame. When the temperature of the catalytic body 57 rises to the active temperature of the catalyst, catalytic combustion begins on the surface of the catalytic body 57 and the flame disappears. The mixed gas supplied to the combustion chamber 58 undergoes catalytic reaction over the entire surface of the catalytic body 57 and generates heat as it passes the gas passage "a" of the catalytic body 57, and the combustion gas after reaction is exhausted from an exhaust port 61.

In general, the amount of combustion of a catalytic combustion apparatus is determined by the area (cross-sectional area) of the entrance of the catalytic body for the mixed gas if the catalytic material and the surface area of the entire catalytic body are the same. Consequently, when only the thickness of the catalytic body is reduced, the area of entrance is also reduced thus making it unable to obtain equivalent combustion characteristics and resulting in a poor combustion rate. For this reason, in this example, entrance area is secured by increasing the width A to compensate for the reduction in the thickness T of the catalytic body 57. As a result, according to the present example, the thickness can be reduced without reducing the combustion characteristics. Furthermore, as the catalytic body 57 is configured by continuous processing of a thin metal sheet as described before thereby to provide a large surface area per unit volume, further downsizing is enabled when compared with the prior art.

Next, a description will be given of the system of supplying a mixed gas to the catalytic body 57 as adopted in this example. The ejection velocity of the fuel gas ejected from the nozzle 53 is on the order of several 100 m/sec and the velocity of flow of the mixed gas flowing out from the mixing chamber 55 is also very high. In order to uniformly supply the mixed gas to the low-profile catalytic body 57, it is necessary to reduce the flow velocity of the mixed gas and to make the distribution of flow velocity uniform over the entire entrance of the combustion chamber 58. In general practice, a diffuser is provided at the exit of the mixing chamber 55 to gradually widen the area of the passage thereby making the flow velocity uniform. However, in this method, a longer diffuser is needed as the width of the entrance of the combustion chamber 58 increases, thereby resulting in a catalytic combustion apparatus having longer length and larger width.

On the contrary, in this example, a communicating straight cylindrical gas passage 56 is provided at the exit of the mixing chamber 55 as has been described, and an entrance to the combustion chamber 58 is formed on a side of the straight cylindrical gas passage 56 so as to communicate with the entrance. In other words, the positional relationship between the mixing chamber 55 and the catalytic body 57 is not serial but parallel. As a result, according to this example, the overall length of the combustion apparatus can be shortened and the apparatus can be compactly configured.

The mixed gas from the mixing chamber 55 first linearly flows inside the straight cylindrical gas passage 56. When the mixed gas impinges the front end portion 56*a* of the straight cylindrical gas passage 56, a reverse flow is caused inside the straight cylindrical gas passage 56 due to impingement. This reverse flow and the mixed gas supplied by the mixing chamber 55 interfere with each other. As a result, the flow velocity inside the straight cylindrical gas passage 56 becomes drastically small, static pressure of the entire inside of the straight cylindrical gas passage 56 increases, and the mixed gas flows to the direction of the combustion chamber 58 that communicates with the side of 50 the straight cylindrical gas passage 56. In this example, as illustrated in FIG. 21, the length of the straight cylindrical gas passage 56 is designed to be longer than the width of the entrance of the combustion chamber 58 and the entrance portion of the combustion chamber 58 is disposed within the length of the straight cylindrical gas passage 56. To be more specific, the position of the end portion of the combustion chamber 58 is recessed by a distance D from the end portion 56*a* of the straight cylindrical gas passage 56. Consequently, the reverse flow gas arising from the impingement at the front end portion 56*a* of the straight cylindrical passage 56 is prevented from directly entering into the combustion chamber 58, and the mixed gas uniformly mixed with air can be uniformly supplied into the combustion chamber 58. In other words, as the mixed gas is supplied to the combustion chamber 58 at this stage, the flow velocity has reduced due to the above described interference, the overall static pressure has risen, and the mixed gas to be supplied to the combustion chamber 58 will become one in which the fuel gas and air are more uniformly mixed during the time the static pressure rises. Also, the distribution of flow velocity of the mixed gas at the entrance of the combustion chamber 58 will become uniform thereby enabling uniform supply of the mixed gas to the catalytic body 57.

According to experiments by the present inventors, the catalytic combustion apparatus of the present example provides combustion heat of 60 watts or higher when the size is 6 mm in thickness and 50 mm in length. Consequently, when it is used in a warming cloth to be worn for warming the body, for example, there will be no feeling of discomfort and a product with superior portability may be realized.

Also, an apparatus with combustion heat on the order of 10 watts can be rightfully configured smaller and thinner than the above-mentioned dimension thus enabling use in small warmers such as gloves, shoes, or socks, for warming fingers or toes, or in thermotherapy curing devices for treatment by applying the hot spot to arbitrary effective points.

Furthermore, in this example, a gas resistant body 62 made of metal mesh or expanded metal or the like is provided at the exit of the mixing chamber 55 as illustrated in FIG. 21. The gas resistant body 62 reduces the flow velocity of the mixed gas coming out from the mixing chamber 55 thereby reducing the flow velocity inside the straight cylindrical gas passage 56. As a result, the distribution of flow velocity of the mixed gas at the entrance of the combustion chamber 58 can be made further uniform. In other words, by the use of the gas resistant body 62, the diameter of the straight cylindrical gas passage 56 can be made smaller thereby enabling reduction of the overall size of the combustion apparatus.

In addition, in this example, a gas rectifier 63 made of metal mesh or expanded metal or the like is provided at the entrance of the combustion chamber 58. The gas rectifier 63 acts in a manner such that a mixed gas flowing from the straight cylindrical gas passage 56 to the combustion chamber 58 is rectified. Even when a vortex of mixed gas flow is produced inside the straight cylindrical gas passage 56 due to reasons such as fluctuation in the quantity of flow of the fuel gas, stable supply of mixed gas to the entire catalytic body 57 is enabled.

EXAMPLE—12

Figure 24:
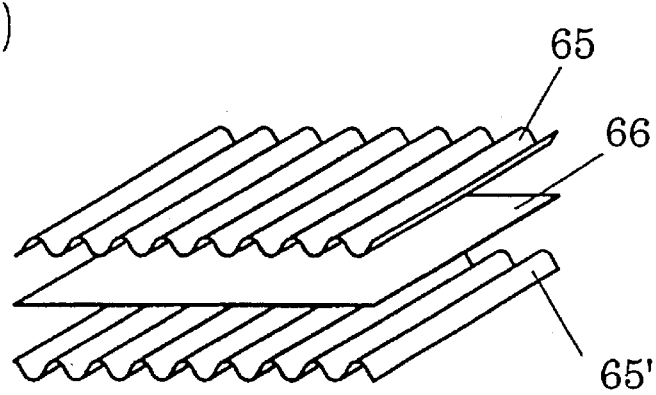
FIG. 24(*a*) is a disassembled perspective view of a catalytic body employed in a catalytic combustion apparatus in a twelfth example of the present invention, and FIG. 24(*b*) is a perspective view of the catalytic body after being assembled.
Figure 24:
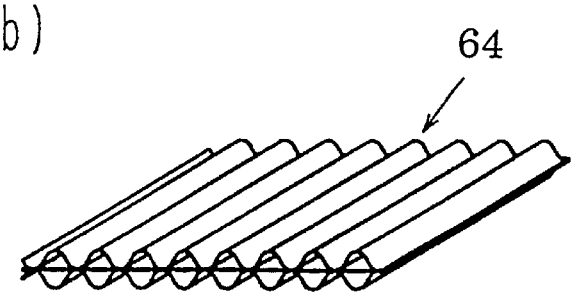

Next, a description will be given on a twelfth example of the present invention. FIG. 24(*a*) is an exploded perspective view of a catalytic body 64 employed in a catalytic combustion apparatus of the present example. FIG. 24(*b*) is an assembled perspective view of the catalytic body 64. The catalytic body 64 is comprised of corrugated sheets 65 and 65' made by continuously folding thin metal sheets of stainless steel or the like and a flat plate 66 of a thin metal sheet. In this example, the corrugated sheets 65 and 65' are made of 0.05 mm thick thin metal sheets and the flat plate 66 is made of a 0.1 mm thick thin metal sheet. A catalyst carrier is configured by stacking by spot welding, for example, one or more of these into a multilayer structure. The catalyst supported by this catalyst carrier is the same as described in the first example. Similar to the description in the first example, the catalytic body 64 is of a flat plate configuration in which the planar area is greater than the cross-sectional area. Also, when housed in a combustion chamber 58, the waved portion forms a gas passage along which a mixed gas flows in the lateral direction.

According to the twelfth example, by configuring the catalytic body 64 with a multilayer body of metal as has been described above, the surface area per unit volume can be made greater than the configuration described in the first example. As a result, when the size of the catalytic body is the same, larger amounts of combustion can be obtained.

Also, when the catalytic combustion apparatus is in operation, the flat plate 66 will not come into contact with the inner wall of the combustion chamber 58. Consequently, when adjusting the temperature of the flat plate 66 which has risen higher than the temperature of the corrugated sheets 65 and 65' by turning on and off the fuel gas, it is easy to maintain an active temperature of the catalyst. That is, elimination of combustion is made difficult.

Also, the temperature difference between upstream and downstream portions of the mixed gas undergoing catalytic combustion on the catalytic body 64 is made smaller by the heat unifying action of the flat plate 66. Accordingly, the present example is also advantageous to the life of the catalytic body 64.

Even though the corrugated sheets 65 and 65' were configured from 0.05 mm thick thin metal sheets and the flat plate 66 from a 0.1 mm thick thin metal sheet, the thickness is not restricted to these values.

EXAMPLE—13

Figure 25:
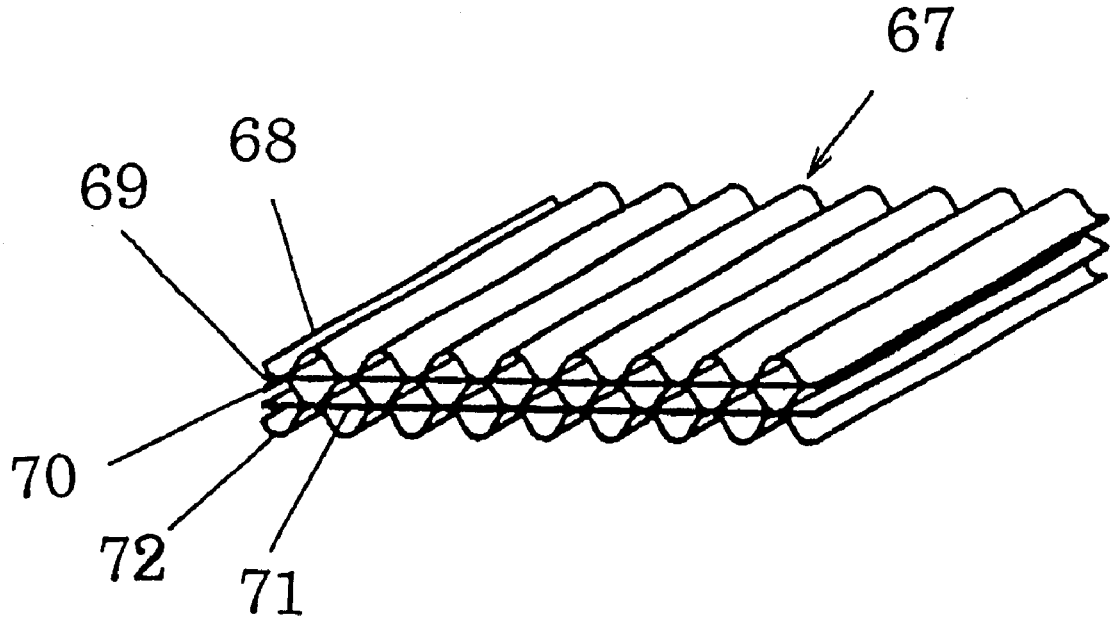
FIG. 25 is a perspective view to illustrate the structure of a catalytic body employed in a catalytic combustion apparatus in a thirteenth example of the present invention.

Next, a description will be given of a thirteenth example of the present invention. FIG. 25 is a perspective view to illustrate the configuration of a catalytic body 67 employed in a catalytic combustion apparatus of the present invention. In this example, the catalytic combustion apparatus comprises a corrugated sheet 68 made by folding a thin metal sheet in the form of continuous waves, a corrugated sheet 70 made similarly, a corrugated sheet 72 made similarly, a flat plate 69 made of a thin metal sheet, and a flat plate 71 made similarly. A multilayer metal catalyst is made by joining these sheets and plates by spot welding, for example.

With the configuration of the present example, an amount of combustion approximately 1.5 times that of the configuration described in the twelfth example is obtained. As has been described above, according to the present example, the entrance area for a mixed gas and the surface area of the catalyst can be enlarged by increasing the number of stacked layers, and catalytic bodies with different amounts of combustion can be fabricated by increasing or decreasing only the number of components for configuring the catalytic body. Consequently, standardization of components is made easy thus enabling low cost manufacturing.

EXAMPLE—14

Figure 26:
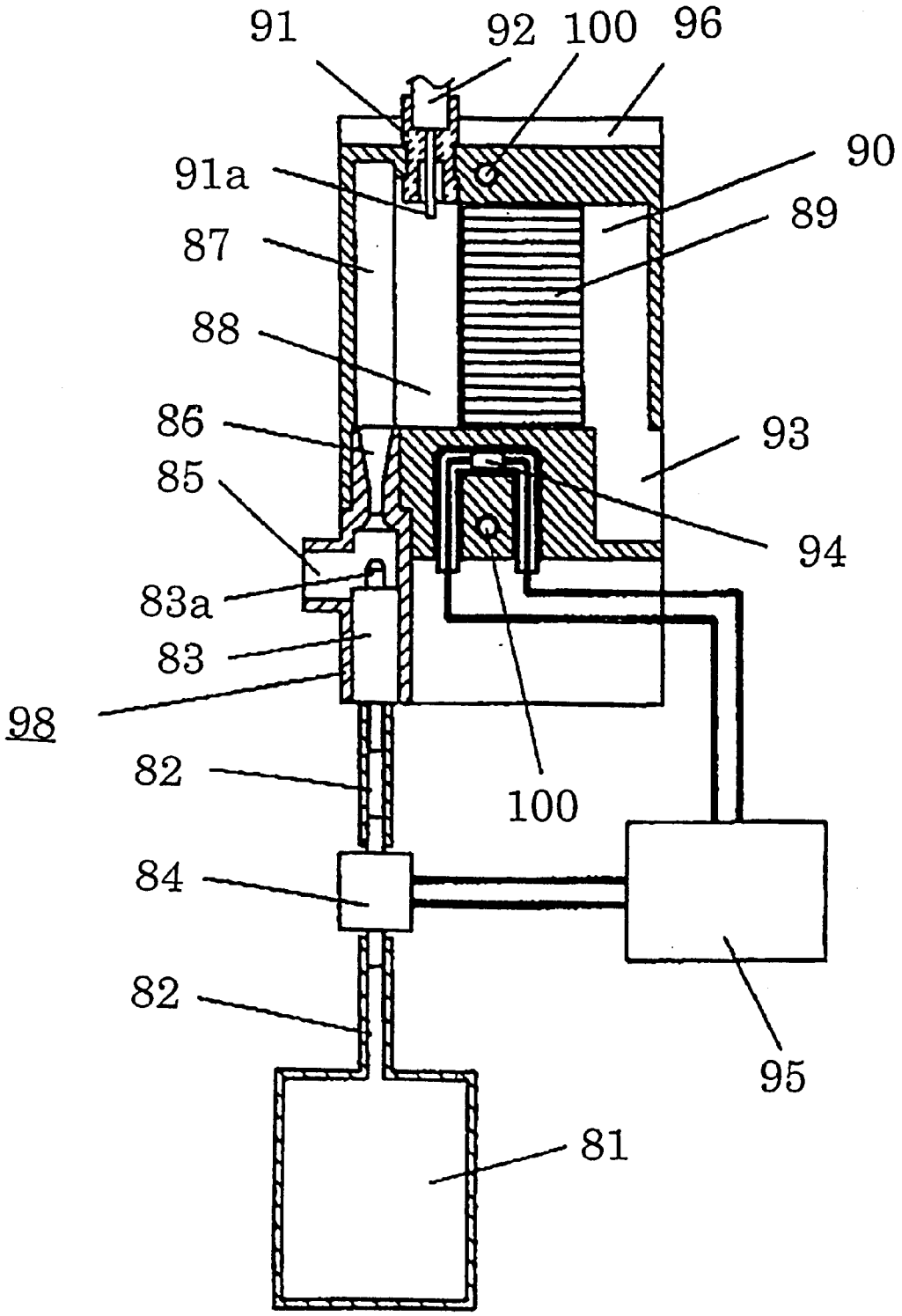
FIG. 26 is a cross-sectional view to illustrate the structure of a catalytic combustion apparatus in a fourteenth example of the present invention.

A description of a fourteenth example of the present invention will be given in the following. FIG. 26 is a cross-sectional view to illustrate the configuration of a catalytic combustion apparatus of the present example. Numeral 81 is a gas tank for storing liquefied petroleum gas such as butane or propane. The fuel gas inside the gas tank 81 is ejected from ejection outlet 83*a* of a nozzle 83 via a gas passage 82. A control valve 84 for adjusting gas flow rate is provided between the gas tank 81 and the nozzle 83. The fuel gas ejected from the ejection outlet 83*a* draws in air through an air intake 85 and is mixed with air in a mixing chamber 86. The exit of the mixing chamber 86 communicates with a roughly cylindrical gas passage 87. A side of the cylindrical gas passage 87 communicates with a combustion chamber 90 having a catalytic body 89 via a firing chamber 88 which is disposed adjacent to the side of the gas passage 87.

Figure 27:
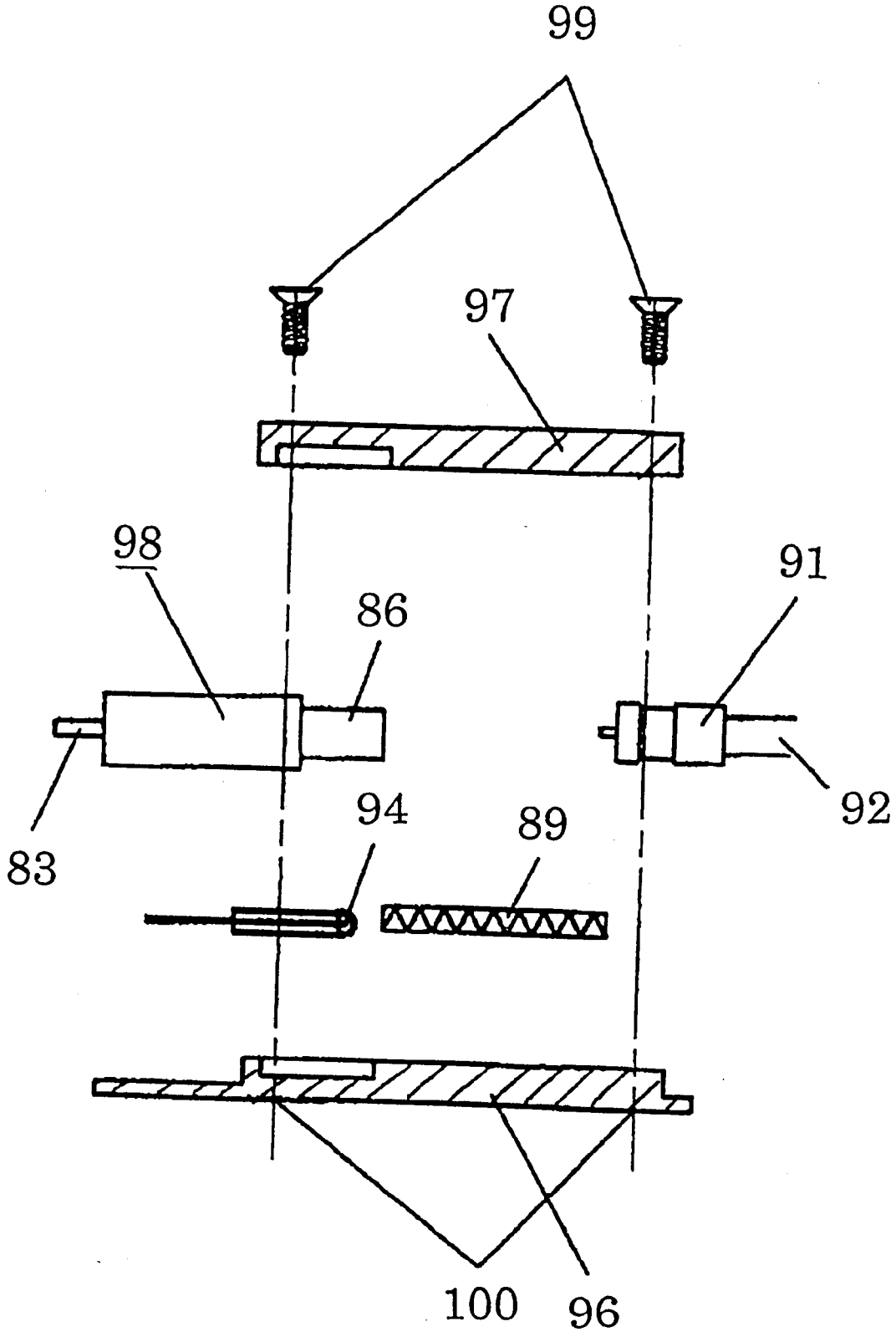
FIG. 27 is a disassembled side view of a catalytic combustion apparatus in the fourteenth example of the present invention.

The catalytic body 89 has a honeycomb cross-section as illustrated by a side view of FIG. 27, for example, and supports as a catalyst a platinum group metal or oxide of such metals as nickel, iron, manganese, or chromium on a carrier formed by corrugating thin metal sheets of stainless steel or the like. The fuel gas mixed with air undergoes catalytic combustion by catalytic action while it passes inside the catalytic body 89 after passing through the gas passage 87 and the firing chamber 88.

Also, an ignition device 91 is provided on the upper part of the firing chamber 88. When starting the apparatus, a spark (high voltage electric discharge spark) is generated by a plug 91*a* on the tip by operating the ignition device 91. With this spark, a flame is formed inside the firing chamber 88, and the catalytic body 89 is heated by the flame. Numeral 92 is a high tension wire to supply electricity to the ignition device 91. When the temperature of the catalytic body 89 rises and reaches an active temperature of the catalyst, heat is generated on the surface of the catalytic body 89 due to catalytic reaction, and the combustion gas after reaction is exhausted from an exhaust port 93. Numeral 94 is a temperature detecting means for detecting the temperature of the combustion chamber 90 and comprises a thermistor, thermocouple or the like, and is connected to a control unit 95. The control unit 95 is designed in a manner such that it controls the quantity of ejection of the fuel gas by driving a control valve 84 depending on the output from the temperature detecting means 94 and adjusts the temperature of the combustion chamber 90.

Figure 28:
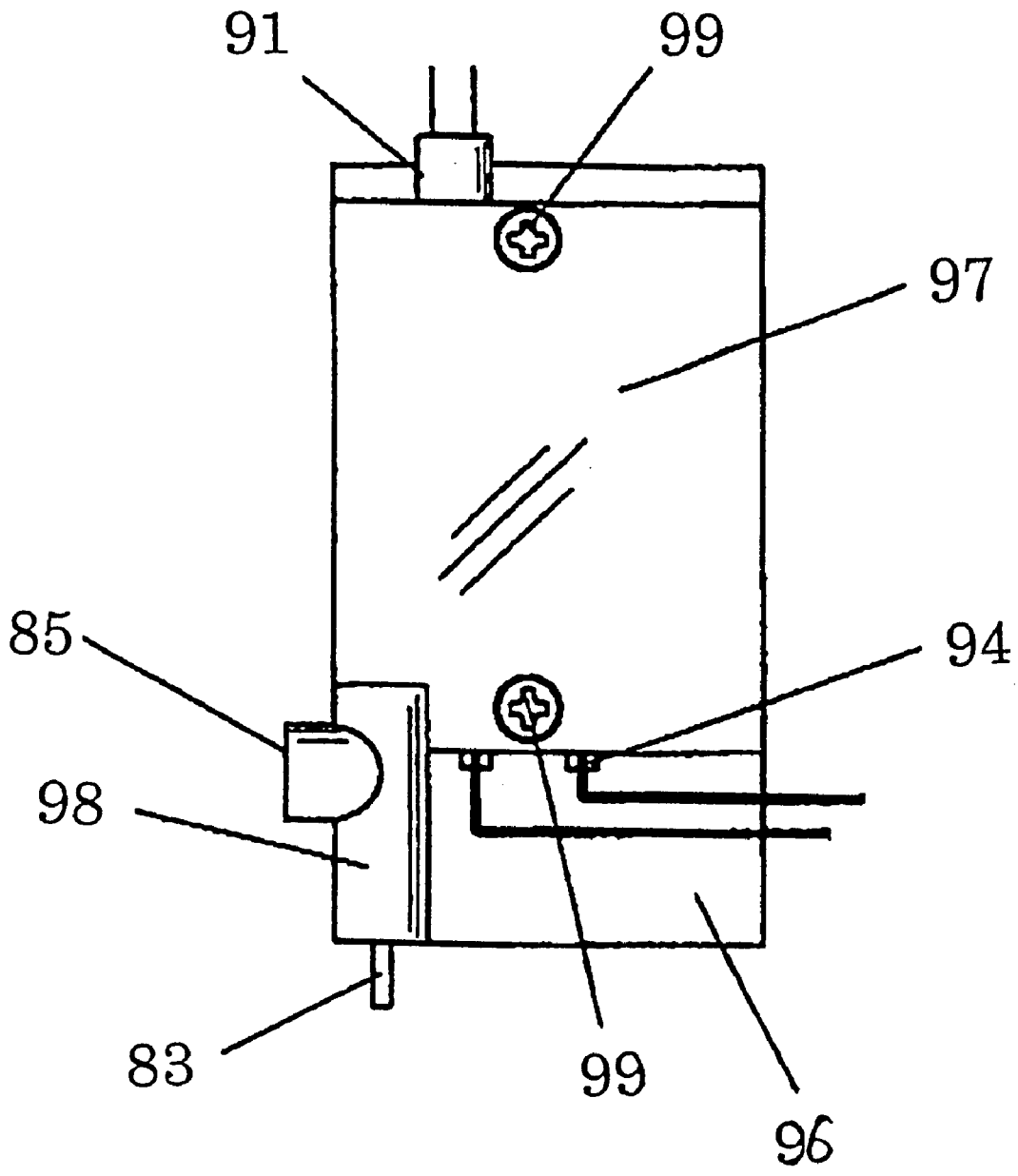
FIG. 28 is a top view of the catalytic combustion apparatus in the fourteenth example of the present invention.
Figure 29:
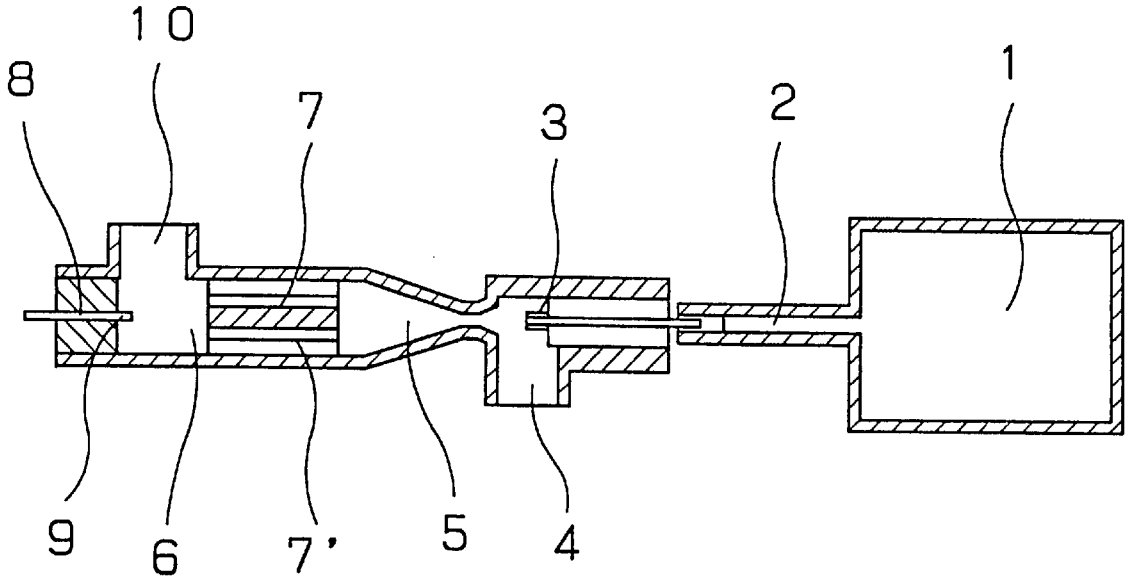
Fig. 29 PRIOR ART
FIG. 29 is a cross-sectional view to illustrate the structure of a prior art catalytic combustion apparatus.

The components used in the above system of the fourteenth example will now be described. As illustrated in FIG. 26, FIG. 27, and FIG. 28, the combustion chamber 90, the firing chamber 88, and the gas passage 87, comprise two components divided by a plane parallel to the direction of flow of the mixed gas, namely, a lower base 96 and an upper base 97. Numeral 98 is a nozzle unit that integrates the air intake 85, the mixing chamber 86, and the nozzle 83 and is made by inserting the nozzle 83 into a cast component. It is also possible to configure the nozzle unit as an integral unit entirely by performing cutting operations. In this example, as illustrated in FIGS. 27 and 28, the nozzle unit 98, catalytic body 89, ignition device 91, and temperature detecting means 94 are sandwiched between the two components, namely, the lower base 96 and the upper base 97, at a predetermined position, and secured by screwing fixing screws 99 into screw holes 100 provided on the lower base 96.

By making the nozzle 83 and the mixing chamber 86, that require a high degree of precision of processing, as separate and divisible components from the combustion chamber 90, and the firing chamber 88, the shape of the lower base 96 and the upper base 97 can be simplified thereby making processing easy, allowing reduction of the material thickness to a minimum thus enabling downsizing and a thinner design. Also, the nozzle unit 98 itself which requires a high degree of precision processing is made easier to process, suggesting the possibility of further downsizing by configuring an integral unit by preforming cutting operations as described before.

Also, as the combustion chamber 90 is divided into the lower base 96 and the upper base 97 by a plane roughly in parallel to the direction of ejection of the nozzle, the configuration for processing of the combustion chamber 90 section is greatly simplified thereby making processing easy, allowing reduction of the material thickness to a minimum thus achieving a low profile.

Furthermore, as the combustion chamber 90 section is divided into upper and lower units, housing of the catalytic body 89 during assembly is made easy. Also, the assembling of the nozzle unit 98, the ignition device 91, and the temperature detecting means 94 is likewise easily done, especially, as the temperature detecting means 94 has to detect the temperature of the combustion chamber 90 through heat conduction. Although it is a general practice to fix the temperature detecting means 94 by pressing with a separate component made of a good heat conductor to ensure temperature detection, structure for fixing can be simplified by securing it with the lower base 96 and the upper base 97 while sandwiching it as in this configuration, and temperature detection with higher reliability is assured.

INDUSTRIAL APPLICATION

A catalytic combustion apparatus of the present invention comprises a combustor, a fuel tank, a valve, and an ignition device, and the combustor further comprises a gas nozzle, an air intake/ejector, a mixing chamber, a firing chamber, an ignition plug, a combustion chamber, a catalyst for combustion housed in the combustion chamber, and an exhaust port. The mixing chamber is made into a straight cylindrical passage, a cylindrical firing chamber is provided in parallel to the mixing chamber via an opening on the side of the firing chamber communicating with the combustion chamber, a burner port is disposed on the boundary between the mixing chamber and the firing chamber, and the burner port comprises a catalyst net. With this configuration, the catalyst for combustion can start catalytic combustion by forming a flame on the upstream side of the catalyst for combustion and heating the catalyst for combustion to a catalytic combustion enabling temperature with the heat of the flame thereby also causing catalytic combustion on the catalytic net, whereupon the flame spontaneously is extinguished allowing the combustion catalyst to commence catalytic combustion and suggesting that catalytic combustion can be effected without fail even when the combustion chamber is configured with a low profile. Furthermore, as the combustion takes place on both the catalytic net and the catalyst for combustion, the temperature rise of the catalyst for combustion is kept small and its life is lengthened. As a result, the thickness of the catalytic body can be made smaller without sacrificing the igniting characteristics and durability, thereby enabling reduction in the burner height and providing a smaller and thinner catalytic combustion apparatus.

What is claimed is:

1. A catalytic combustion apparatus comprising:

a passage for creating a mixture of air and fuel gas;

a combustion chamber, in fluid communication with said passage along a first direction that is generally transverse to a direction along which the air and fuel gas are to be introduced into said passage, for receiving the mixture of air and fuel gas from said passage along said first direction;

a catalyst for combustion within said combustion chamber;

a firing chamber in fluid communication with said passage along said first direction and in fluid communication with said combustion chamber along said first direction, wherein said combustion chamber is in fluid communication with said passage along said first direction via said firing chamber; and a burner port between said passage and said firing chamber, said burner port comprising a plate having through holes, wherein said passage is in fluid communication with said firing chamber along said first direction via said through holes.

2. The catalytic combustion apparatus according to claim 1, wherein said plate comprises a net supporting a catalyst.

3. The catalytic combustion apparatus according to claim 2, wherein said passage is at least partially defined by a wall, and part of said net is in contact with said wall.

4. The catalytic combustion apparatus according to claim 1, wherein said passage includes an inlet through which air and fuel gas are to be introduced into said passage, and said firing chamber is at least partially defined by a wall, and further comprising:

an ignition device on said wall at a position that is opposite to said inlet.

5. The catalytic combustion apparatus according to claim 1, further comprising:

a combustor that includes said passage, said firing chamber and said combustion chamber;

a fuel tank, in fluid communication with said combustor, for supplying fuel gas to said combustor;

an ignition device, in operative association with said combustor, for igniting the fuel gas within said combustor; and a solenoid valve, positioned between said fuel tank and said combustor, for controlling the supply of fuel gas from said fuel tank to said combustor, wherein said solenoid valve is to be closed within a predetermined time period after said ignition device has ignited the fuel gas within said combustor such that supply of additional fuel gas from said fuel tank to said combustor is prevented, and subsequently said solenoid valve is to be re-opened to allow additional supply of fuel gas from said fuel tank to said combustor.

6. The catalytic combustion apparatus according to claim 1, further comprising:

a combustor that includes said passage, said firing chamber and said combustion chamber, and further includes an air intake;

an ignition device, in operative association with said combustor, for igniting fuel gas within said combustor; and an air-intake shutter, positioned at said air intake of said combustor, for controlling the supply of air into said combustor, wherein said air-intake shutter is to be operated within a predetermined time period after said ignition device has ignited the fuel gas within said combustor such that supply of air into said combustor is controlled.

7. The catalytic combustion apparatus according to claim 1, further comprising:

a combustor that includes said passage, said firing chamber and said combustion chamber;

an ignition device, in operative association with said combustor, for igniting fuel gas within said combustor; and structure, in operative association with said burner port, for adjusting an effective area of said through holes such that the supply of the mixture of air and fuel gas into said firing chamber from said passage is controllable, wherein said structure is to be operated within a predetermined time period after said ignition device has ignited the fuel gas within said combustor such that the supply of the mixture of air and fuel gas into said firing chamber from said passage is controlled.

8. The catalytic combustion apparatus according to claim 7, wherein said structure for adjusting the effective area of said through holes comprises a movable plate that has through holes corresponding to said through holes of said plate of said burner port, such that the supply of the mixture of air and fuel gas to said firing chamber from said passage is controllable by moving said movable plate relative to said plate of said burner port, whereby said through holes of said movable plate become aligned with said through holes of said plate of said burner port or become mis-aligned with said through holes of said plate of said burner port.

9. The catalytic combustion apparatus according to claim 1, further comprising:

a combustor that includes said passage, said firing chamber and said combustion chamber, and further includes a temperature sensor;

a fuel tank, in fluid communication with said combustor, for supplying fuel gas to said combustor; and a solenoid valve, positioned between said fuel tank and said combustor, for controlling the supply of fuel gas from said fuel tank to said combustor, wherein said solenoid valve is to be temporarily closed in response to a temperature sensed by said temperature sensor.

10. The catalytic combustion apparatus according to claim 1, further comprising:

a combustor that includes said passage, said firing chamber and said combustion chamber, and further includes an air intake and a temperature sensor; and an air-intake shutter, positioned at said air intake of said combustor, for controlling the supply of air into said combustor, wherein said air-intake shutter is to be operated in response to a temperature sensed by said temperature sensor.

11. The catalytic combustion apparatus according to claim 1, further comprising:

a combustor that includes said passage, said firing chamber and said combustion chamber, and further includes a temperature sensor; and structure, in operative association with said burner port, for adjusting an effective area of said through holes such that the supply of the mixture of air and fuel gas into said firing chamber from said passage is controllable, wherein said structure is to be operated in response to a temperature sensed by said temperature sensor.

12. The catalytic combustion apparatus according to claim 11, wherein said structure for adjusting the effective area of said through holes comprises a movable plate that has through holes corresponding to said through holes of said plate of said burner port, such that the supply of the mixture of air and fuel gas to said firing chamber from said passage is controllable by moving said movable plate relative to said plate of said burner port, whereby said through holes of said movable plate become aligned with said through holes of said plate of said burner port or become mis-aligned with said through holes of said plate of said burner port.

13. The catalytic combustion apparatus according to claim 1, wherein a part of said catalyst for combustion projects into said firing chamber.

14. The catalytic combustion apparatus according to claim 1, wherein said catalyst for combustion includes a first surface contained within a plane, with said first surface having a length and a width, said catalyst combustion apparatus also includes a second surface contained within a plane, with said second surface having a width that extends transverse to the width of said first surface and is less than the width of said first surface, and with said second surface having a length that extends parallel to the length of said first surface and is equal to the length of said first surface, and said catalytic combustion apparatus also includes passages extending along the width of said first surface to allow for the flow of gas through said passages.

15. The catalytic combustion apparatus according to claim 1, wherein said catalyst for combustion comprises a catalyst supported by a catalyst support that comprises a thin metal corrugated carrier that defines alternating peaks and valleys, with said peaks being contained within a plane and bound by an area defined by a width of said peaks and a first length from a first of said peaks to a last of said peaks, said thin metal corrugated carrier also defines a side surface having a width that is less than and extends transverse to the width of said peaks and also having a length that extends parallel to and is equal to said first length, and with the area between said peaks and valleys defining passages extending along the width of said peaks to allow for the flow of gas through said passages.

16. The catalytic combustion apparatus according to claim 15, wherein said catalyst support further includes a flat plate on said peaks and another said thin metal corrugated carrier on said flat plate.

17. A catalytic combustion apparatus comprising:

a passage for creating a mixture of air and fuel gas;

a combustion chamber, in fluid communication with said passage along a first direction that is generally transverse to a direction along which the air and fuel gas are to be introduced into said passage, for receiving the mixture of air and fuel gas from said passage along said first direction;

a catalyst for combustion within said combustion chamber; and a firing chamber in fluid communication with said passage along said first direction and in fluid communication with said combustion chamber along said first direction, wherein said combustion chamber is in fluid communication with said passage along said first direction via said firing chamber, wherein said passage, said firing chamber and said combustion chamber are defined between plural components that are separated from one another by a plane that extends generally parallel to the direction in which the air and fuel gas are to be introduced into said passage and generally transverse to said first direction.

18. The catalytic combustion apparatus according to claim 17, wherein said plural components define said combustion chamber, and a component body integrating a mixing chamber and a nozzle is sandwiched between and secured to said plural components such that said passage is in fluid communication with said nozzle via said mixing chamber.

* * * * *